US007110700B2

(12) United States Patent
Andoh et al.

(10) Patent No.: US 7,110,700 B2
(45) Date of Patent: Sep. 19, 2006

(54) BELT DRIVING CONTROLLER, PROCESS CARTRIDGE, AND IMAGE FORMING APPARATUS

(75) Inventors: Toshiyuki Andoh, Kanagawa (JP); Yasumori Nagahara, Kanagawa (JP); Tadashi Shinohara, Kanagawa (JP); Yuuji Matsuda, Tokyo (JP); Kazuhiko Kobayashi, Tokyo (JP); Nobuto Yokokawa, Saitama (JP); Masato Yokoyama, Kanagawa (JP); Yohhei Miura, Tokyo (JP); Toshiyuki Takahashi, Kanagawa (JP); Jun Hosokawa, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 232 days.

(21) Appl. No.: 10/927,303

(22) Filed: Aug. 27, 2004

(65) Prior Publication Data

US 2005/0085945 A1 Apr. 21, 2005

(30) Foreign Application Priority Data

Aug. 29, 2003 (JP) ..... 2003-306584

(51) Int. Cl.
*G03G 15/00* (2006.01)

(52) U.S. Cl. ..... 399/167; 399/111; 399/302; 399/303; 399/308

(58) Field of Classification Search ..... 399/107, 399/111, 159, 162, 165, 167, 302, 303, 308
See application file for complete search history.

(56) References Cited

U.S. PATENT DOCUMENTS 4,951,160 A 8/1990 Nagahara et al.
5,130,583 A 7/1992 Andoh
5,265,188 A 11/1993 Andoh
5,289,088 A 2/1994 Andoh
5,321,483 A 6/1994 Yokoyama et al.
5,404,206 A 4/1995 Andoh et al.
5,598,254 A 1/1997 Ikesue et al.
5,606,408 A 2/1997 Yano et al.
5,619,316 A 4/1997 Shoji et al.
5,638,159 A 6/1997 Kai et al.
5,646,749 A 7/1997 Omi et al.
5,719,684 A 2/1998 Ohkaji et al.
5,737,665 A 4/1998 Sugiyama et al.
5,765,083 A 6/1998 Shinohara
5,774,772 A 6/1998 Kai et al.
5,799,229 A 8/1998 Yokoyama et al.
5,875,380 A 2/1999 Iwata et al.
5,878,317 A 3/1999 Masuda et al.

(Continued)

FOREIGN PATENT DOCUMENTS

JP 11-231754 8/1999

(Continued)

*Primary Examiner*—Hoan Tran
(74) *Attorney, Agent, or Firm*—Oblon, Spivak, McClelland, Maier & Neustadt, P.C.

(57) ABSTRACT

A belt driving controller includes a driving roller having a radius r1, a plurality of driven rollers that is driven by rotation of the driving roller, the driven rollers having a radius r2, an endless belt that is wound on the driving roller and the driven rollers and an encoder that is attached to one of the driven rollers, and that outputs a signal. The rotation of the driving roller is controlled based on the signal from the encoder, and $(\alpha 2/\alpha 1)\times(r1/r2)\leqq 1$ is satisfied where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

54 Claims, 11 Drawing Sheets

U.S. PATENT DOCUMENTS 5,915,155 A 6/1999 Shoji et al.
5,962,783 A 10/1999 Iwata et al.
5,963,240 A 10/1999 Shinohara et al.
5,999,773 A 12/1999 Yasutomi et al.
6,031,633 A 2/2000 Andoh et al.
6,038,423 A * 3/2000 Tagawa et al. ..... 399/301
6,118,557 A 9/2000 Sugiyama et al.
6,125,243 A 9/2000 Shoji et al.
6,128,459 A 10/2000 Iwata et al.
6,167,221 A 12/2000 Kobayashi
6,282,396 B1 8/2001 Iwata et al.
6,295,435 B1 9/2001 Shinohara et al.
6,295,438 B1 9/2001 Fujishiro et al.
6,380,960 B1 4/2002 Shinohara
6,381,435 B1 4/2002 Shinohara et al.
6,573,918 B1 6/2003 Kobayashi et al.
6,587,137 B1 7/2003 Shinohara et al.
6,593,951 B1 7/2003 Yokoyama et al.
6,690,896 B1 2/2004 Hanada et al.
6,693,654 B1 2/2004 Shinohara
6,704,035 B1 3/2004 Kobayashi
6,708,017 B1 3/2004 Yamanaka et al.
6,711,364 B1 3/2004 Shinohara
6,714,224 B1 3/2004 Yamanaka et al.
6,868,244 B1 * 3/2005 Koide ..... 399/167
6,949,896 B1 * 9/2005 Andoh et al. ..... 318/135
6,996,357 B1 * 2/2006 Matsuda et al. ..... 399/167

FOREIGN PATENT DOCUMENTS

JP 2000-330353 11/2000
JP 2001-66909 3/2001
JP 2001-337547 12/2001
JP 2002-91115 3/2002
JP 2003-263005 9/2003

* cited by examiner

BELT DRIVING CONTROLLER, PROCESS CARTRIDGE, AND IMAGE FORMING APPARATUS

CROSS-REFERENCE TO RELATED APPLICATIONS

The present document incorporates by reference the entire contents of Japanese priority document, 2003-306584 filed in Japan on-Aug. 29, 2003.

BACKGROUND OF THE INVENTION

1) Field of the Invention

The present invention relates to a belt driving controller, a process cartridge that includes the belt driving controller, and an image forming apparatus that employs the belt driving controller.

2) Description of the Related Art

Conventionally, an endless belt is wound on a driving roller and one or a plurality of driven rollers, and is driven by transmitting rotation of a drive motor to the driving roller via a drive transmitting member to rotate the driven roller(s).

A belt driving apparatus that includes the above mechanism is disclosed in, for example, Japanese Patent Application Laid-Open Publication No. 2001-66909. In the belt driving unit, an encoding roll is attached to the driven roller in contact with the endless belt to generate a pulse in response to a speed of the belt, and the pulse is fed into a controller to control the drive motor.

With this scheme, since the endless belt is not wound on the driven roller, the driven roller is not influenced by fluctuation in thickness of the belt. However, there is a difficulty in controlling the belt driving unit well because it is not possible to completely remove a slip between the driven roller and the endless belt.

Some conventional belt driving unites include an encoder for each of the driving roller and the driven roller so that the angular speeds of both the driving roller and the driven roller are detected by each of the encoders to find a difference between the angular speeds. The difference is detected by an up-down counter, and the difference is superposed on a speed control system of the drive motor to perform a feedback control of the drive motor.

In the belt driving controller of this type, a belt winding angle on the driven roller to which the encoder is attached is made large so that the slip between the driven roller and the endless belt can be eliminated.

Such a technology is disclosed in, for example, Japanese Patent Application Laid-Open Publication No. 2000-330353.

However, since the endless belt is wound on the driven roller, the driven roller is influenced by the fluctuation in thickness of the belt, and the angular speed cannot be accurately measured and controlled. Further, since the endless belt is similarly wound on the driving roller, the driving roller is influenced by the fluctuation in the thickness of the belt. As a result, the belt cannot be driven at a constant speed even when the driving roller is rotated at a constant angular speed.

SUMMARY OF THE INVENTION

It is an object of the present invention to solve at least the above problems in the conventional technology.

A belt driving controller according to one aspect of the present invention includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on the signal from the encoder, and following relation is satisfied $$(\alpha 2/\alpha 1)\times(r1/r2)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

A belt driving controller according to another aspect of the present invention includes a driving roller; a plurality of driven rollers that is driven by rotation of the driving roller; an endless belt that is wound on the driving roller and the driven rollers; and an encoder that is attached to one of the driven rollers, and that outputs a signal. Following relation is satisfied $$(\alpha 2/\alpha 1)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

A belt driving controller according to still another aspect of the present invention includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on a signal from the encoder, and following relation is satisfied $$(r1/r2)\leqq 1.$$

A process cartridge according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers;.and an encoder that is attached to one of the driven rollers, and that outputs a signal. The rotation of the driving roller is controlled based on the signal from the encoder, and following relation is satisfied $$(\alpha 2/\alpha 1)\times(r1/r2)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

A process cartridge according to still another aspect of the present invention includes a belt driving controller that includes a driving roller; a plurality of driven rollers that is driven by rotation of the driving roller; an endless belt that is wound on the driving roller and the driven rollers; and an encoder that is attached to one of the driven rollers, and that outputs a signal. Following relation is satisfied $$(\alpha 2/\alpha 1)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

A process cartridge according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on a signal from the encoder, and following relation is satisfied $$(r1/r2) \leqq 1.$$

An image forming apparatus according to still another aspect of the present invention includes a process cartridge that includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on a signal from the encoder, and following relation is satisfied $$(\alpha 2/\alpha 1) \times (r1/r2) \leqq 1$$

where $\alpha$1 is a correction coefficient for a fluctuation in thickness of the endless belt caused by a belt winding angle on the driving roller, and $\alpha$2 is a correction coefficient for a fluctuation in the thickness on the driven roller.

An image forming apparatus according to still another aspect of the present invention includes a process cartridge that includes a belt driving controller that includes a driving roller; a plurality of driven rollers that is driven by rotation of the driving roller; an endless belt that is wound on the driving roller and the driven rollers; and an encoder that is attached to one of the driven rollers, and that outputs a signal. Following relation is satisfied $$(\alpha 2/\alpha 1) \leqq 1$$

where $\alpha$1 is a correction coefficient for a fluctuation in thickness of the endless belt caused by a belt winding angle on the driving roller, and $\alpha$2 is a correction coefficient for a fluctuation in the thickness on the driven roller.

An image forming apparatus according to still another aspect of the present invention includes a process cartridge that includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on a signal from the encoder, and following relation is satisfied $$(r1/r2) \leqq 1.$$

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on the signal from the encoder, and following relation is satisfied $$(\alpha 2/\alpha 1) \times (r1/r2) \leqq 1$$

where $\alpha$1 is a correction coefficient for a fluctuation in thickness of the endless belt caused by a belt winding angle on the driving roller, and $\alpha$2 is a correction coefficient for a fluctuation in the thickness on the driven roller.

35. An image forming apparatus according to still another aspect of the present invention includes a belt driving controller that includes a driving roller; a plurality of driven rollers that is driven by rotation of the driving roller; an endless belt that is wound on the driving roller and the driven rollers; and an encoder that is attached to one of the driven rollers, and that outputs a signal. Following relation is satisfied $$(\alpha 2/\alpha 1) \leqq 1$$

where $\alpha$1 is a correction coefficient for a fluctuation in thickness of the endless belt caused by a belt winding angle on the driving roller, and $\alpha$2 is a correction coefficient for a fluctuation in the thickness on the driven roller.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on a signal from the encoder, and following relation is satisfied $$(r1/r2) \leqq 1.$$

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on the signal from the encoder, and following relation is satisfied $$(\alpha 2/\alpha 1) \times (r1/r2) \leqq 1$$

where $\alpha$1 is a correction coefficient for a fluctuation in thickness of the endless belt caused by a belt winding angle on the driving roller, and $\alpha$2 is a correction coefficient for a fluctuation in the thickness on the driven roller. The endless belt is a transfer material conveying member that conveys a transfer material on which a toner image formed on a photosensitive element is directly or indirectly transferred to form an image in an image forming apparatus. The apparatus forms monochrome toner images in different colors on the photosensitive elements, and sequentially transfers each of the monochrome toner images to a transfer material to form a combined toner image.

An image forming apparatus according to still another aspect of the present invention includes a belt driving controller that includes a driving roller; a plurality of driven rollers that is driven by rotation of the driving roller; an endless belt that is wound on the driving roller and the driven rollers; and an encoder that is attached to one of the driven rollers, and that outputs a signal. Following relation is satisfied $$(\alpha 2/\alpha 1) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The endless belt is a transfer material conveying member that conveys a transfer material on which a toner image formed on a photosensitive element is directly or indirectly transferred to form an image in an image forming apparatus The apparatus forms monochrome toner images in different colors on the photosensitive elements, and sequentially transfers each of the monochrome toner images to a transfer material to form a combined toner image.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on a signal from the encoder, and following relation is satisfied $$(r1/r2) \leqq 1.$$

The endless belt is a transfer material conveying member that conveys a transfer material on which a toner image formed on a photosensitive element is directly or indirectly transferred to form an image in an image forming apparatus. The apparatus forms monochrome toner images in different colors on the photosensitive elements, and sequentially transfers each of the monochrome toner images to a transfer material to form a combined toner image.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on the signal from the encoder, and following relation is satisfied $$(\alpha 2/\alpha 1) \times (r1/r2) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The endless belt is an image carrier on which a toner image is carried, the toner directly or indirectly transferred to a transfer material to form an image. The image carrier is a belt-type photosensitive element, and the apparatus forms a monochrome toner image on the photosensitive element and directly transfers the toner image to the transfer material to form an image.

An image forming apparatus according to still another aspect of the present invention includes a belt driving controller that includes a driving roller; a plurality of driven rollers that is driven by rotation of the driving roller; an endless belt that is wound on the driving roller and the driven rollers; and an encoder that is attached to one of the driven rollers, and that outputs a signal. Following relation is satisfied $$(\alpha 2/\alpha 1) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The endless belt is an image carrier on which a toner image is carried, the toner directly or indirectly transferred to a transfer material to form an image, and the image carrier is a belt-type photosensitive element. The apparatus forms a monochrome toner image on the photosensitive element and directly transfers the toner image to the transfer material to form an image.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on a signal from the encoder, and following relation is satisfied $$(r1/r2) \leqq 1.$$

The endless belt is an image carrier on which a toner image is carried, the toner directly or indirectly transferred to a transfer material to form an image, and the image carrier is a belt-type photosensitive element. The apparatus forms a monochrome toner image on the photosensitive element and directly transfers the toner image to the transfer material to form an image.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on the signal from the encoder, and following relation is satisfied $$(\alpha 2/\alpha 1) \times (r1/r2) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The endless belt is an image carrier on which a toner image is carried, the toner directly or indirectly transferred to a transfer material to form an image, and the image carrier is a belt-type photosensitive element. The apparatus sequentially forms monochrome toner images in different colors on one of the photosensitive elements, sequentially transfers each of the monochrome toner images to an intermediate transfer element to form a combined toner image, and collectively transfers the combined toner image to the transfer material to form a multicolor image.

An image forming apparatus according to still another aspect of the present invention includes a belt driving controller that includes a driving roller; a plurality of driven rollers that is driven by rotation of the driving roller; an endless belt that is wound on the driving roller and the driven rollers; and an encoder that is attached to one of the driven rollers, and that outputs a signal. Following relation is satisfied $$(\alpha 2/\alpha 1) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The image carrier is a belt-type photosensitive element, and the image carrier is a belt-type photosensitive element. The apparatus sequentially forms monochrome toner images in different colors on one of the photosensitive elements, sequentially transfers each of the monochrome toner images to an intermediate transfer element to form a combined toner image, and collectively transfers the combined toner image to the transfer material to form a multicolor image.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on a signal from the encoder, and following relation is satisfied $$(r1/r2) \leqq 1.$$

The endless belt is an image carrier on which a toner image is carried, the toner directly or indirectly transferred to a transfer material to form an image, and the image carrier is a belt-type photosensitive element. The apparatus sequentially forms monochrome toner images in different colors on one of the photosensitive elements, sequentially transfers each of the monochrome toner images to an intermediate transfer element to form a combined toner image, and collectively transfers the combined toner image to the transfer material to form a multicolor image.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on the signal from the encoder, and following relation is satisfied $$(\alpha 2/\alpha 1) \times (r1/r2) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The endless belt is an image carrier on which a toner image is carried, the toner directly or indirectly transferred to a transfer material to form an image, and the image carrier is a belt-type intermediate transfer element on which a toner image on a photosensitive element is transferred. The apparatus forms monochrome toner images in different colors on one of the photosensitive elements, sequentially transfers each of the respective monochrome toner images to the intermediate transfer element to form a combined toner image, and collectively transfers the combined toner image to the transfer material to form a multicolor image.

An image forming apparatus according to still another aspect of the present invention includes a belt driving controller that includes a driving roller; a plurality of driven rollers that is driven by rotation of the driving roller; an endless belt that is wound on the driving roller and the driven rollers; and an encoder that is attached to one of the driven rollers, and that outputs a signal. Following relation is satisfied $$(\alpha 2/\alpha 1) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The endless belt is an image carrier on which a toner image is carried, the toner directly or indirectly transferred to a transfer material to form an image, and the image carrier is a belt-type intermediate transfer element on which a toner image on a photosensitive element is transferred. The apparatus forms monochrome toner images in different colors on one of the photosensitive elements, sequentially transfers each of the respective monochrome toner images to the intermediate transfer element to form a combined toner image, and collectively transfers the combined toner image to the transfer material to form a multicolor image.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on a signal from the encoder, and following relation is satisfied $$(r1/r2) \leqq 1.$$

The endless belt is an image carrier on which a toner image is carried, the toner directly or indirectly transferred to a transfer material to form an image, and the image carrier is a belt-type intermediate transfer element on which a toner image on a photosensitive element is transferred. The apparatus forms monochrome toner images in different colors on one of the photosensitive elements, sequentially transfers each of the respective monochrome toner images to the intermediate transfer element to form a combined toner image, and collectively transfers the combined toner image to the transfer material to form a multicolor image.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on, the driving roller and the driven rollers; and an encoder that is attached to one of the driven rollers, and that outputs a signal. The rotation of the driving roller is controlled based on the signal from the encoder, and following relation is satisfied $$(\alpha 2/\alpha 1) \times (r1/r2) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The endless belt is an image carrier on which a toner image is carried, the toner directly or indirectly transferred to a transfer material to form an image, and the image carrier is a belt-type intermediate transfer element on which a toner image on a photosensitive element is transferred. The apparatus forms monochrome toner images in different colors on one of the photosensitive elements, sequentially transfers each of the respective monochrome toner images to the intermediate transfer element to form a combined toner image, and collectively transfers the combined toner image to the transfer material to form a multicolor image.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on the signal from the encoder, and following relation is satisfied $$(\alpha 2/\alpha 1)\times(r1/r2)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The endless belt is an image carrier on which a toner image is carried, the toner directly or indirectly transferred to a transfer material to form an image, and the image carrier is a belt-type intermediate transfer element on which a toner image on a photosensitive element is transferred. The apparatus forms monochrome toner images in different colors on the photosensitive elements, sequentially transfers each of the monochrome toner images to the intermediate transfer element to form a combined toner image, and collectively transfers the combined toner image to a transfer material to form a multicolor image.

An image forming apparatus according to still another aspect of the present invention includes a belt driving controller that include a driving roller; a plurality of driven rollers that is driven by rotation of the driving roller; an endless belt that is wound on the driving roller and the driven rollers; and an encoder that is attached to one of the driven rollers, and that outputs a signal. Following relation is satisfied $$(\alpha 2/\alpha 1)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The endless belt is an image carrier on which a toner image is carried, the toner directly or indirectly transferred to a transfer material to form an image, and the image carrier is a belt-type intermediate transfer element on which a toner image on a photosensitive element is transferred. The apparatus forms monochrome toner images in different colors on the photosensitive elements, sequentially transfers each of the monochrome toner images to the intermediate transfer element to form a combined toner image, and collectively transfers the combined toner image to a transfer material to form a multicolor image.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on the signal from the encoder, and following relation is satisfied $$(\alpha 2/\alpha 1)\times(r1/r2)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The endless belt is an image carrier on which a toner image is carried, the toner directly or indirectly transferred to a transfer material to form an image, and the belt driving controller is provided in an image forming apparatus that transfers a first image and a second image that are formed in an image forming unit to form a toner image on both sides of a transfer material substantially at the same time. The image carrier is a belt-type intermediate transfer element on which an image that is previously formed in the image forming unit is transferred as the first image, and an image previously formed in the image forming units is temporarily transferred to carry a first image on the belt-type intermediate transfer element and the first image carried on the intermediate transfer element and a second image additionally formed in the image forming units are substantially simultaneously transferred to the transfer material to form a toner image on each side of the transfer material.

An image forming apparatus according to still another aspect of the present invention includes a belt driving controller that includes a driving roller; a plurality of driven rollers that is driven by rotation of the driving roller; an endless belt that is wound on the driving roller and the driven rollers; and an encoder that is attached to one of the driven rollers, and that outputs a signal. Following relation is satisfied $$(\alpha 2/\alpha 1)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller. The endless belt is an image carrier on which a toner image is carried, the toner directly or indirectly transferred to a transfer material to form an image, and the belt driving controller is provided in an image forming apparatus that transfers a first image and a second image that are formed in an image forming unit to form a toner image on both sides of a transfer material substantially at the same time. The image carrier is a belt-type intermediate transfer element on which an image that is previously formed in the image forming unit is transferred as the first image. An image previously formed in the image forming units is temporarily transferred to carry a first image on the belt-type intermediate transfer element and the first image carried on the intermediate transfer element and a second image additionally formed in the image forming units are substantially simultaneously transferred to the transfer material to form a toner image on each side of the transfer material.

An image forming apparatus according to still another aspect of the present invention includes a belt driving controller that includes a driving roller having a radius r1; a plurality of driven rollers that is driven by rotation of the driving roller, the driven rollers having a radius r2; an endless belt that is wound on the driving roller and the driven rollers; and an encoder that is attached to one of the driven rollers, and that outputs a signal. The rotation of the driving roller is controlled based on a signal from the encoder, and following relation is satisfied $$(r1/r2)\leqq 1.$$

The endless belt is an image carrier on which a toner image is carried, the toner directly or indirectly transferred to a transfer material to form an image. The belt driving controller is provided in an image forming apparatus that transfers a first image and a second image that are formed in an image forming unit to form a toner image on both sides of a transfer material substantially at the same time. The image carrier is a belt-type intermediate transfer element on which an image that is previously formed in the image forming unit is transferred as the first image, and an image previously formed in the image forming units is temporarily transferred to carry a first image on the belt-type intermediate transfer element and the first image carried on the intermediate transfer element and a second image additionally formed in the image forming units are substantially simultaneously transferred to the transfer material to form a toner image on each side of the transfer material.

The other objects, features, and advantages of the present invention are specifically set forth in or will become apparent from the following detailed description of the invention when read in conjunction with the accompanying drawings.

The other objects, features, and advantages of the present invention are specifically set forth in or will become apparent from the following detailed description of the invention when read in conjunction with the accompanying drawings.

DETAILED DESCRIPTION

Exemplary embodiments of a belt driving controller, a process cartridge, and an image forming apparatus according to the present invention will be explained in detail with reference to the accompanying drawings.

Figure 1:
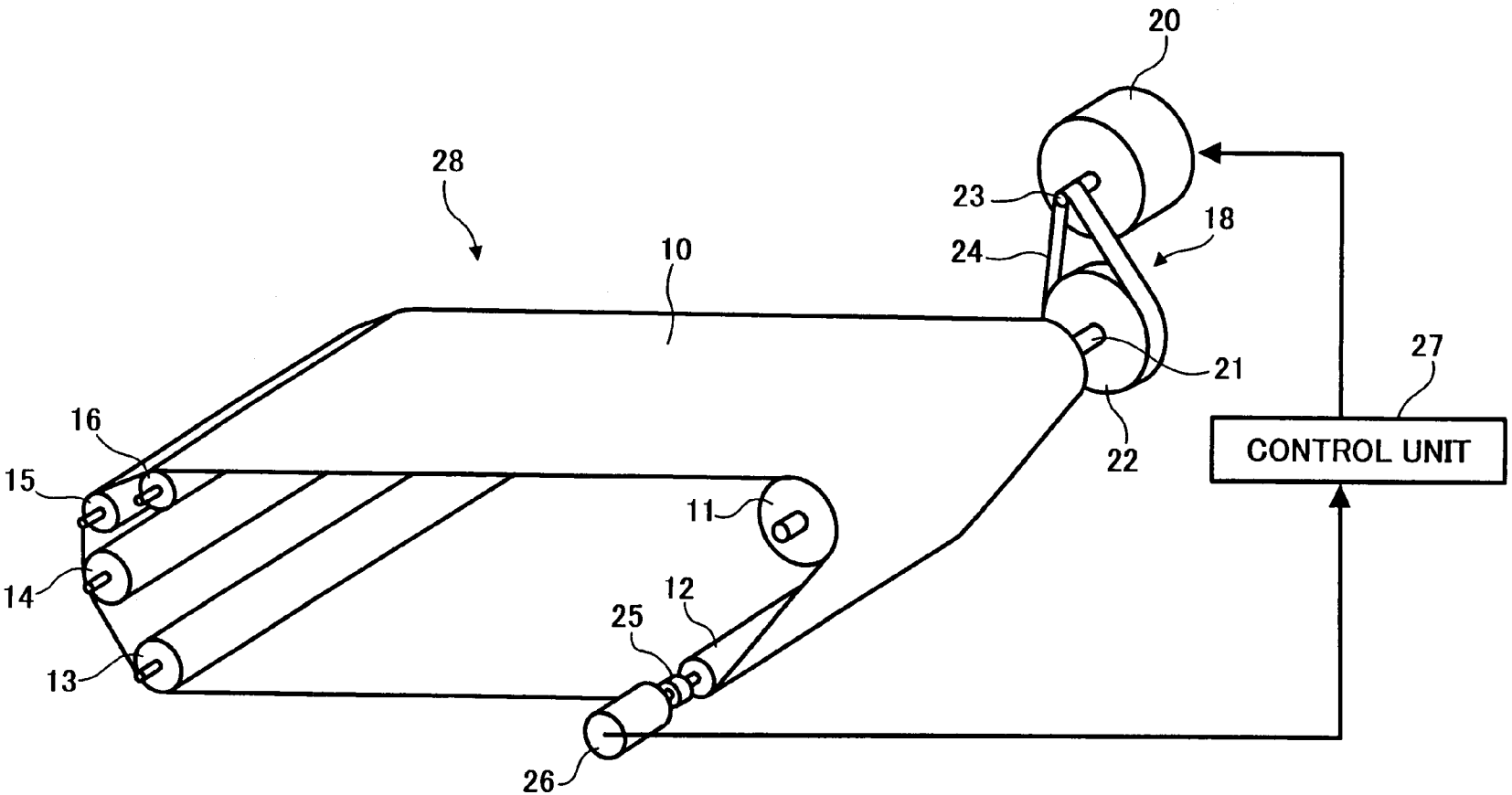
FIG. 1 is a perspective view of a belt driving controller according to the present invention.

FIG. 1 is a perspective view of a belt driving controller according to the present invention. An endless belt 10 is made of PVDF (polyvinylidene fluoride). The endless belt 10 is wound on a driving roller 11 and a plurality of driven rollers 12 to 16 that are supported in parallel to each other by a supporting member (not shown).

Rotation of a drive motor 20 is decelerated and transmitted to the driving roller 11 via a drive transmitting unit 18. A pulley 22 is provided on a drive shaft 21 of the driving roller 11, and a timing belt 24 is wound on the pulley 22 and an output shaft 23 of the drive motor 20. The drive motor 20 may employ a DC motor, an AC motor, or the like although a step motor is used in the depicted embodiment.

On the other hand, an encoder 26 is attached to the driven roller 12 among the driven rollers 12 to 16 at its driven shaft via a coupling 25. The encoder 26 is connected to a controlling unit 27. The controlling unit 27 is connected to the drive motor 20.

The rotation of the drive motor 20 is transmitted to the driving roller 11 via the drive transmitting unit 18 to rotate the driven rollers 12 to 16 to drive the endless belt 10. A signal is output from the encoder 26 while the driven roller 12 rotates. The signal is input into the controlling unit 27. The controlling unit 27 performs feedback control of rotation of the drive motor 20 based on the signal.

Figure 2:
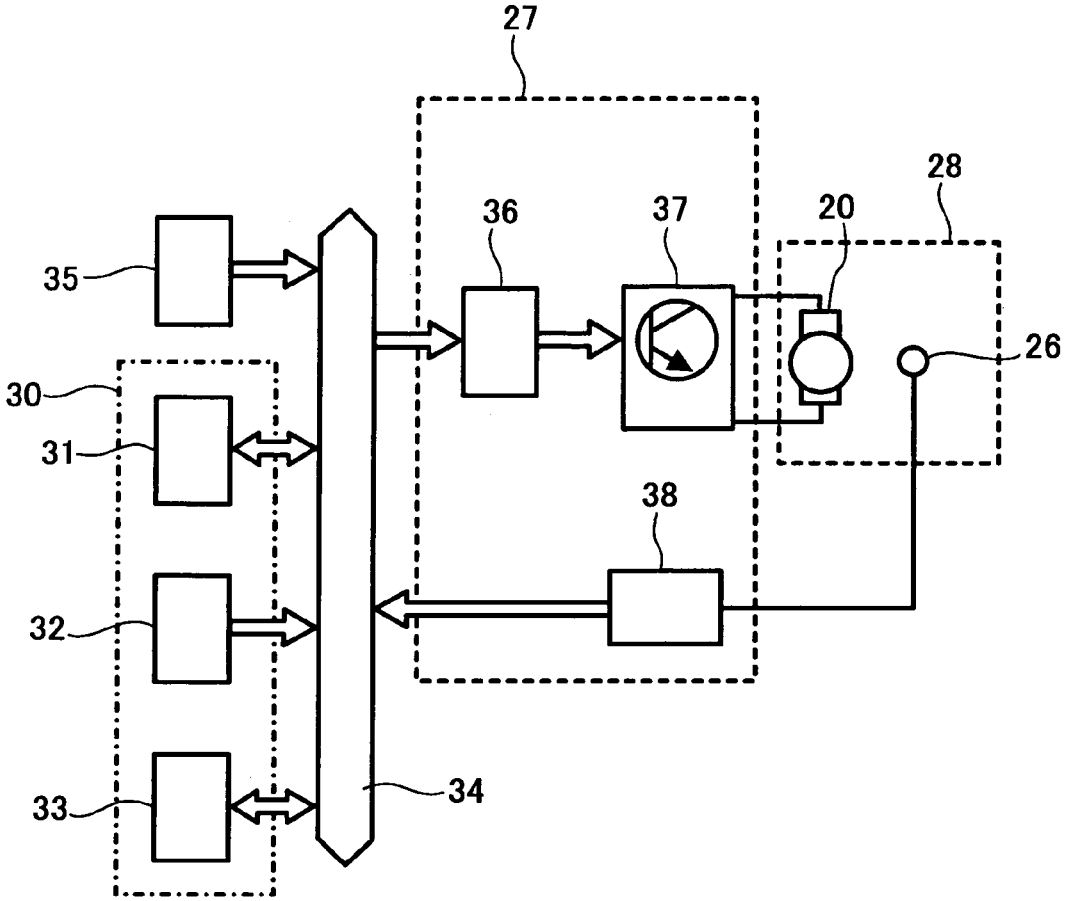
FIG. 2 is a block diagram for explaining control of the belt driving controller.

FIG. 2 is a block diagram for explaining control of the belt driving controller 28 shown in FIG. 1.

A microcomputer 30 includes a microprocessor 31, a read only memory (ROM) 32, and a random access memory (RAM) 33, which are interconnected via a bus 34.

An instruction generating unit 35 outputs a status instruction signal for instructing target angle displacement for the driven roller 12. The instruction generating unit 35 is similarly connected to the bus 34 at its output side. An interface for motor drive 36 converts a computation result (control output) obtained in the microcomputer 30 into a pulse signal (control signal), and operates, for example, a power semiconductor that structures a drive motor driving unit 37.

The drive motor driving unit 37 drives and rotates the drive motor 20 based on the pulse signal from the interface for motor drive 36. As a result, the driven roller 12 is subjected to variable value control to obtain angle displacement predetermined by the instruction generating unit 35.

A detection interface 38 converts the pulse signal output from the encoder 26 into a digital numeric form. The detection interface 38 includes a counter that counts the pulses output from the encoder 26. The detection interface 38 calculates angle displacement for the driven roller 12 by multiplying value counted by the counter by a predetermined conversion constant of pulse number/angle displacement.

Figure 3:
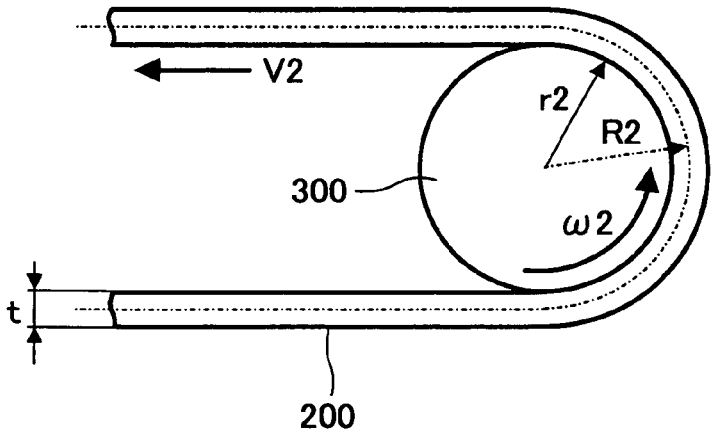
FIG. 3 is an enlarged diagram of surroundings of a driven roller of a typical belt driving controller.

FIG. 3 is an enlarged diagram of surroundings of the driven roller in a typical belt driving controller.

In the belt driving controller, a relationship between a speed V2 of an endless belt 200 and an angular speed ω2 of a driven roller 300 on which the belt 200 is wound is $$\omega 2 = V2/R2$$

where R2 is a virtual drive radius of the endless belt 200.

When a thickness "t" of the endless belt is uniform, the virtual drive radius R2 is $R2$=(radius $r2$ of the driven roller 300)+(half of belt thickness "$t$").

In other words, the radius R2 is constant, and the speed V2 of the belt 200 can be accurately measured when measuring the angular speed ω2 of the driven roller 300.

When the endless belt 200 is formed by, for example, putting and hardening a belt material between an outer frame and an inner frame, if the inner frame is eccentric against the outer frame, the thickness "t" of the endless belt 200 becomes nonuniform, and a periodical fluctuation in the thickness occurs, which is approximated to the sinusoidal wave along the entire length of the belt.

Thus, conventionally, it was considered that ½ of the fluctuation in the thickness influences the measurement error. Therefore, the angular speed ω2 is set as follows based on the fact $$\omega 2 = V2/R2 = V2/(\mathrm{tb_m}/2 + r2 + \Delta tb/4 \cdot \sin(2\pi \mathrm{ft} + \tau)). \quad (1)$$

where, tb_m is an average thickness of the belt, Δtb is a fluctuation in the thickness, "f" is a frequency for one loop of the belt, "t" is time, and τ is a phase difference between the driving roller (not shown) and the driven roller 300 when one loop of the belt is assumed to be 2π.

However, according to our recent experiments, it is determined that the influence by the fluctuation in the thickness of the endless belt 200 is not always half, but changes in response to the winding angle θ2 of the endless belt 200. In other words, when the correction coefficient of the fluctuation in the thickness caused by the belt winding angle θ2 on the driven roller 300 is assumed as α2, the relationship between the winding angel θ2 and the correction coefficient α2 is as shown in FIG. 4.

Figure 4:
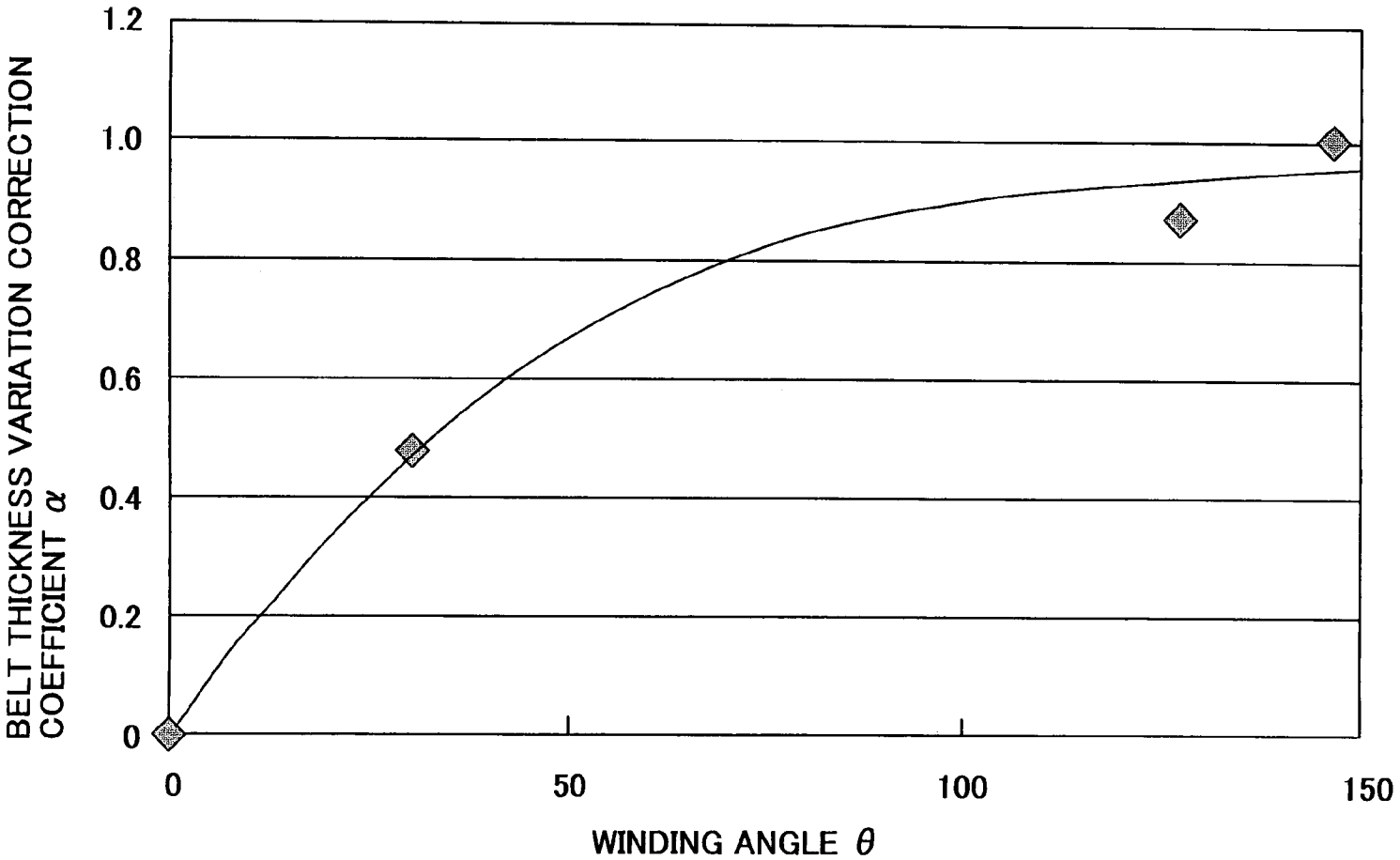
FIG. 4 is a graph of a winding angle θ and a belt thickness fluctuation correction coefficient α in the belt driving controller.

As shown in FIG. 4, when the winding angle θ2 is made smaller, the correction coefficient α2 becomes rapidly closer to 0, and when the winding angle θ2 is made larger, the correction coefficient α2 becomes gradually closer to 1.

As shown in FIG. 4, since the correction coefficient α2 is a function of the winding angle θ, when it is expressed as α(θ2), ω2 in a formula (1) is expressed as follows $$\omega 2 = V2/R2 = V2/(\alpha(\theta 2) \cdot \mathrm{tb_m}/2 + r2 + \alpha(\theta 2) \cdot \Delta tb/4 \cdot \sin(2\pi \mathrm{ft} + \tau)). \quad (2)$$

Figure 5:
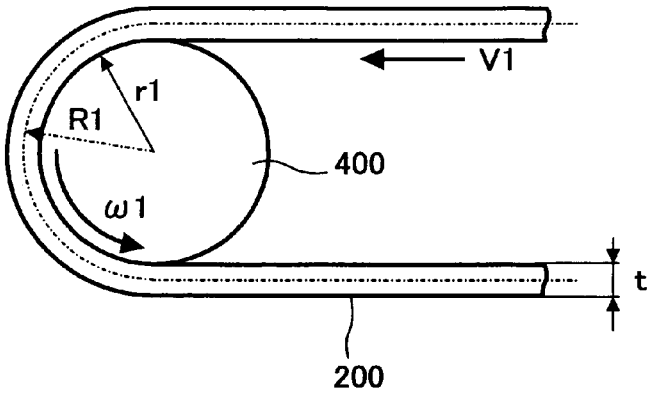
FIG. 5 is an enlarged diagram of surroundings of a driving roller of the typical belt driving controller.

FIG. 5 is an enlarged diagram of surroundings of a driving roller 400 in a typical belt driving controller.

Also for the driving roller 400, a fluctuation in speed of the endless belt 200 that is caused by the fluctuation in the thickness of the endless belt 200 is considered. When the virtual drive radius of the belt caused by the belt winding angle θ1 on the driving roller 400 is assumed as R1, and if the virtual drive radius R1 is expressed using the correction coefficient α(θ1), the following is obtained $$V1 = \omega 1 \cdot R1 \quad (3)$$

-continued $$= \omega 1(\alpha(\theta 1) \cdot \mathrm{tb_m}/2 + r1 + \alpha(\theta 1) \cdot \Delta tb/4 \cdot \sin(2\pi \mathrm{ft})).$$

where, ω1 is an angular speed of the driving roller 400, V1 is a belt speed, and r1 is a radius of the driving roller 400.

The effect of the driven shaft control is considered as a ratio when the driven shaft control is performed relative to a fluctuation when the driven shaft control is not performed. From (2) and (3), $$\frac{V2}{V1} = \frac{2\ R2}{1\ R2} = \frac{2(\alpha(\theta 2)\ \mathrm{tb_m}/2 + r2 + \alpha(\theta 2)\ \Delta tb/4\ \sin(2\Pi\,\mathrm{ft} + T))}{1(\alpha(\theta 1)\ \mathrm{tb_m}/2 + r1 + \alpha(\theta 1)\ \Delta tb/4\ \sin(2\Pi \mathrm{ft})} \quad (4)$$

is obtained.

When an average value of the virtual drive radius R2 of the endless belt 200 in the driven roller 300 is assumed as R2mean, and an average value of the virtual drive radius R1 of the endless belt 200 in the driving roller 400 is assumed as R1mean, $R2\mathrm{mean} = \alpha(\theta 2) \times (tb_m/2) + r2$, and $R1\mathrm{mean} = \alpha(\theta 1) \times (tb_m/2) + r1$ are obtained, and (4) becomes $$\frac{V2}{V1} = \frac{\varpi 2 \cdot R2\mathrm{mean}(1 + \alpha(\theta_2) \cdot \Delta tb/4 \cdot \sin(2\pi \mathrm{ft} + \tau)/R2\mathrm{mean})}{\varpi 1 \cdot R1\mathrm{mean}(1 + \alpha(\theta_1) \cdot \Delta tb/4 \cdot \sin(2\pi \mathrm{ft})/R1\mathrm{mean})}. \quad (5)$$

To perform the control means to control the average speed of the endless belt 200 to be constant in the driven shaft control and in the driving shaft control. In consideration of $\alpha(\theta 2) \times (tb_m/2) << r2$, and $\alpha(\theta 1) \times (tb_m/2) << r1$, as shown in FIG. 4, since the correction coefficient α on the virtual drive radius of the endless belt 200 is uniquely determined by the winding angle, when only the ratio of the fluctuation components in formula (5) is noted, a following formula is obtained as the effect of the driven shaft control for the fluctuation in the thickness $$\frac{\text{Variation of } V2}{\text{Variation of } V1} = \frac{\alpha(\theta 2)}{\alpha(\theta 1)} \cdot \frac{r1}{r2} = \frac{\alpha 2}{\alpha 1} \cdot \frac{r1}{r2}. \quad (6)$$

In other words, it is set so that (α2/α1)×(r1/r2) is equal to or less than 1. It can be easily realized by setting the winding angle θ2 of the driven roller 300 to be smaller than that of the driving roller 400 and making the radius r1 of the driving roller 400 smaller than the radius r2 of the driven roller 300 to which the encoder 26 is attached.

Thus, when the encoder 26 is attached to the driven roller 300 to control the endless belt 200, a good driving control system can be realized for the fluctuation components of the thickness without increasing the fluctuation compared to the case where the endless belt 200 is not controlled, that is, the case where the driving shaft control is performed.

Considering the above, the radius r1 of the driving roller 11 is set at twice the radius r2 of the driven roller 12 in the belt driving controller 28 in FIG. 1. But, when the winding angle θ1 of the driving roller 11 is set at 115 degrees while the winding angle θ2 of the driven roller 12 is set at 30 degrees, and when the angles are replaced with the correction efficient ratio (α2/α1) obtained from the relational curve of the winding angle θ and the correction efficient α as shown in FIG. 4, the radius r1 becomes about ½.

Thus, (α2/α1)×(r1/r2)=1 is obtained, and the driving fluctuation in the belt caused by the fluctuation in the thickness is similar to a case in the driving shaft control. Since other frequency is controllable, the effect of the control will appear comprehensively.

When the winding angle θ1 of the driving roller 11 is set at 100 degrees while the winding angle θ2 of the driven roller 12 is set at 25 degrees, and (α2/α1) is set at less than 1, even if the ratio (r1/r2) of the radii of the driving roller 11 and the driven roller 12 cannot be set as expected, the driving fluctuation in the belt can be reduced for the fluctuation components of the thickness. Thus, the permissible range of the fluctuation in the thickness can be widened.

Figure 6:
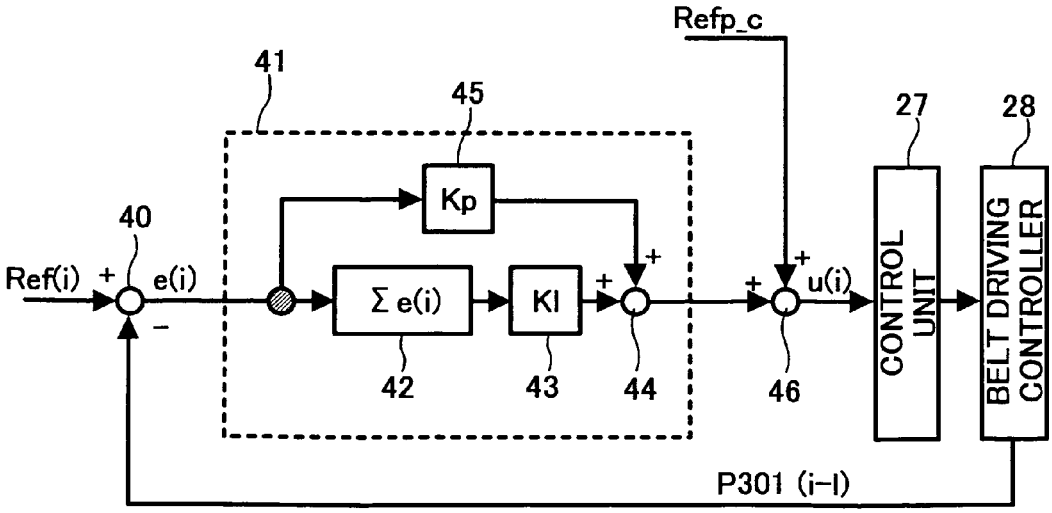
FIG. 6 is a block diagram of driving control for a drive motor in the belt driving controller shown in FIG. 1.

FIG. 6 is a block diagram of driving control for the drive motor 20 in the belt driving controller 28 in FIG. 1.

The pulse output from the encoder 26 in the belt driving controller 28 is converted into a digital signal in the detection interface 38 as shown in FIG. 2. The digital signal converted is input into the microcomputer 30 as angular displacement information of the driven roller 12. A computing unit 40 in FIG. 6 calculates a difference e(i) between angular displacement P301(i-I) input via the detection interface 38 and target angular displacement Ref(i) of the driven roller 12 which is a control target value. Ref(i) can be easily found by integrating the constant angular speed of the driven roller 12.

The difference e(i) is input into the controller 41. The controller 41 is constituted of, for example, PI control system, and may be constituted of P control, PID control, H∞ control, or the like other than the PI control.

The controller 41 integrates the difference e(i) in a block 42, and multiplies a resultant by a constant "KI" in a block 43. The controller 41 inputs the resultant into a computing unit 44. Further, the controller 41 multiplies the difference e(i) by "Kp" in a block 45, and inputs a resultant into the computing unit 44. The computing unit 44 adds the outputs from the block 43 and the block 45.

The output from the computing unit 44 is input into a computing unit 46, where the output from the computing unit 44 is added with a constant pulse Ref_c to determine a drive pulse frequency u(i). The drive pulse frequency u(i) is input into the interface 36 for motor drive in the controlling unit 27 shown in FIG. 2 to drive and rotate the drive motor 20 in the belt driving controller 28 shown in FIG. 1 by the drive motor driving unit 37.

The constant pulse Ref_c is the number of pulses which is uniquely determined based on the belt speed, the driving roller angular speed based on the belt drive radius, and the deceleration ratio of the deceleration system. In the present invention, the constant pulse Ref_c may be arbitrarily selected within a range where loss of synchronism does not occur during motor driving.

Figure 7:
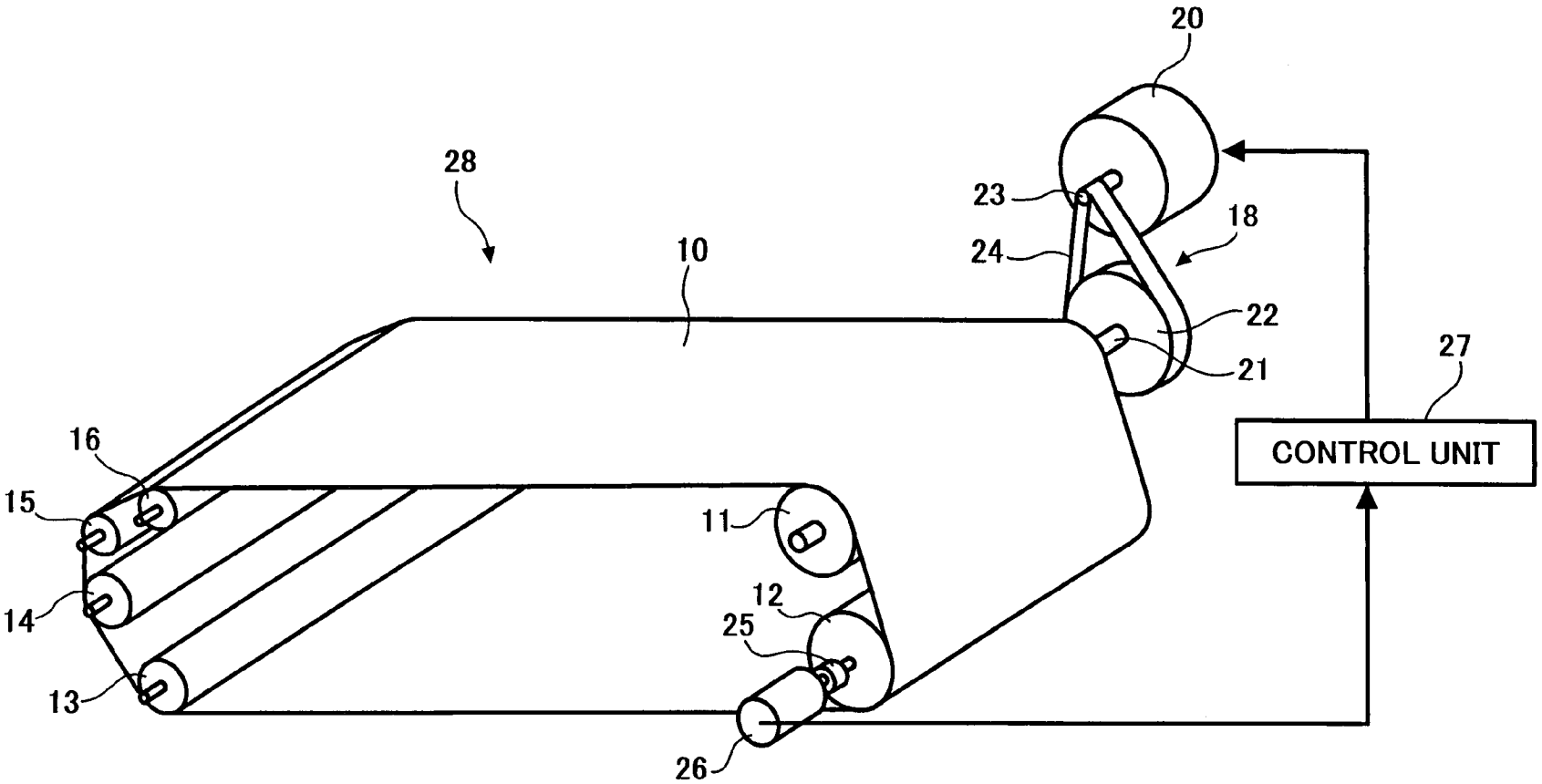
FIG. 7 is a perspective view of a belt driving controller according to another embodiment of the present invention.

FIG. 7 is a perspective view of a belt driving controller according to another embodiment of the present invention.

Similarly as in the belt driving controller 28 in FIG. 1, an endless belt 10 made of PVDF (polyvinylidene fluoride) is Wound on the driving roller 11 and the driven rollers 12 to 16, which are supported by the supporting member (not shown) in parallel with each other.

The rotation of the drive motor 20 is decelerated and transmitted to the driving roller 11 via the drive transmitting unit 18. The pulley 22 is similarly provided on the drive shaft 21 of the driving roller 11, and the timing belt 24 is wound on the pulley 22 and the output shaft 23 of the drive motor 20.

On the other hand, the encoder 26 is similarly attached to one driven roller 12 among the driven rollers 12 to 16 at its driven shaft via the coupling 25. The encoder 26 is connected to the controlling unit 27. The controlling unit 27 is connected to the drive motor 20.

The rotation of the drive motor 20 is transmitted to the driving roller 11 via the drive transmitting unit 18 to rotate the driven rollers 12 to 16, and drives the endless belt 10. A signal is output from the encoder 26 while the driven roller 12 rotates. The signal is input into the controlling unit 27. The controlling unit 27 performs the feedback control of the drive motor 20 based on the signal.

In the embodiment in FIG. 7, the winding angle θ1 of the driving roller 11 is set to be smaller than the winding angle θ2 of the driven roller 12. But the radius r2 of the driven roller 12 is set to be larger than the radius r1 of the driving roller 11 and r1/r2 is set at equal to or less than 1. Therefore, the driving fluctuation of the belt can be reduced for the fluctuation components of the thickness of the belt. Thus, the permissible range of the fluctuation in the thickness of the belt can be widened.

Figure 8:
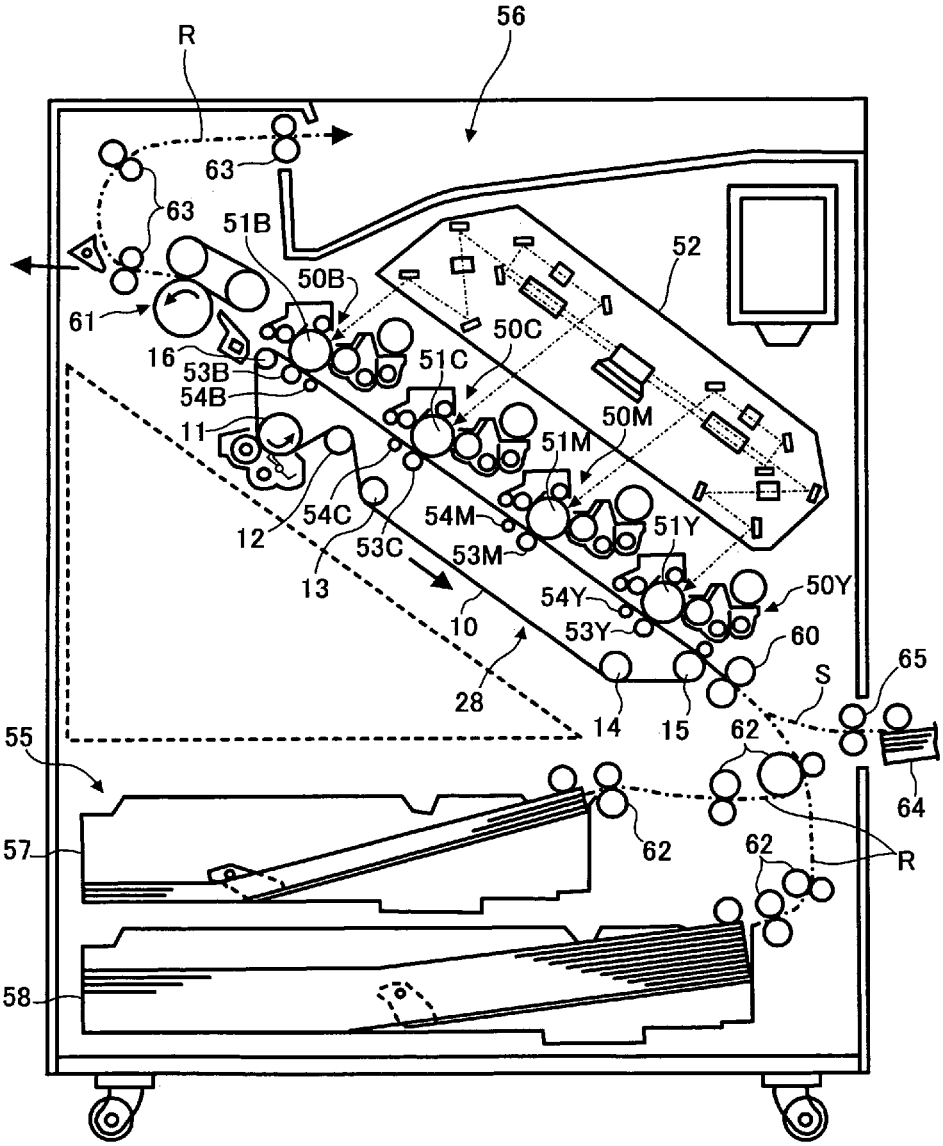
FIG. 8 is a schematic diagram of a direct transfer tandem type color image forming apparatus according to an embodiment of the present invention where the belt driving controller is applied to a unit that conveys a transfer material.

FIG. 8 is a schematic diagram of a direct transfer tandem type color image forming apparatus where the belt driving controller 28 is applied to a unit that conveys a transfer material.

A belt driving controller 28 used as a transfer material conveying unit, which winds the endless belt 10 as the transfer material conveying member on the driving roller 11 and the driven rollers 12 to 16. The endless belt 10 is extended obliquely to a line between the driving roller 11 and the driven roller 16 and straightly between the driven roller 15, which is an inlet roller, and the driven roller 16, which is an outlet roller.

Four image forming units 50Y, 50M, 50C, and 50B for yellow Y, magenta M, cyan C, and black B are arranged in a tandem manner outside the endless belt 10 along its extended portion. Each image forming unit is provided with a drum-like photosensitive element 51Y, 51M, 51C, or 51B, and includes a charging unit, a developing unit, a cleaning unit, and the like therearound. A common exposing unit 52 is arranged on the image forming units 50Y, 50M, 50C, and 50B.

Bias rollers 53Y, 53M, 53C, and 53B that provide a sponge or the like on the outer periphery are abutted against the photosensitive elements 51Y, 51M, 51C, and 51B, respectively, across the endless belt 10. Backup rollers 54Y, 54M, 54C, and 54B are in contact with the rear surface of the endless belt 10 near the respective bias rollers.

On the other hand, the image forming apparatus is provided with a transfer material conveying route R that leads from a transfer material storage unit 55 at the lower of the inside of the image forming apparatus body through the position between the endless belt 10 and the photosensitive elements 51Y, 51M, 51C, and 51B to a transfer material stacking unit 56 on the image forming apparatus body. The transfer material storage unit 55 is provided with two transfer material cassettes 57 and 58 in two stages that store transfer materials having different size from each other.

The transfer material conveying route R is provided with a resist roller pair 60 in front of the endless belt 10 and the photosensitive elements 51Y, 51M, 51C, and 51B, and a fixing unit 61 behind the same. A plurality of supplying roller pairs 62 are provided between the transfer material storage unit 55 and the resist roller pair 60, and a plurality of feeding roller pairs 63 are provided between the fixing unit 61 and the transfer material stacking unit 56.

A manual supplying route S that supplies a manual transfer material fed out from a manual tray 64 by the supplying roller pair 65 is joined together with the transfer material conveying route R just before the resist roller pair 60.

During image forming, in the four image forming units 50Y, 50M, 50C, and 50B, the photosensitive elements 51Y, 51M, 51C, and 51B are rotated to uniformly charge surfaces thereof by the charging units, respectively. Writing is individually performed by the common exposing unit 52 to form latent images on the surfaces, and the latent images are developed by attaching toners thereon by the developing unit. Monochrome toner images with yellow Y, magenta M, cyan C, and black B are formed on the photosensitive elements 51Y, 51M, 51C, and 51B, respectively.

On the other hand, a transfer material is fed out from the transfer material cassette 57 or 58 into the transfer material conveying route R to be conveyed by the supplying roller pairs 62 so that the tip thereof is abutted against the resist roller pair 61. Alternatively, a manual transfer material is fed out from the manual tray 64 to be fed into the transfer material conveying route R from the manual supplying route S by the supplying roller pair 65 so that the tip thereof is abutted against the resist roller pair 60.

The resist roller pair 60 is rotated in exact timing, and a transfer material is inserted between the endless belt 10 and the photosensitive elements 51Y, 51M, 51C, 51B. While the transfer material is conveyed as the endless belt 10 travels as the transfer material conveying member, the transfer material is appropriately brought into contact with the corresponding photosensitive elements 51Y, 51M, 51C, and 51B by the backup rollers 54Y, 54M, 54C, and 54B, respectively. Monochrome toner images on the respective photosensitive elements 51Y, 51M, 51C, and 51B are directly and sequentially transferred by the bias rollers 53Y, 53M, 53C, and 53B to form a combined toner image on the transfer material. The transfer material after the image is transferred thereon is inserted into the fixing unit 61 where the transferred image is fixed, and is then conveyed by the feeding roller pairs 63 to be fed out on the transfer material stacking unit 56.

Figure 9:
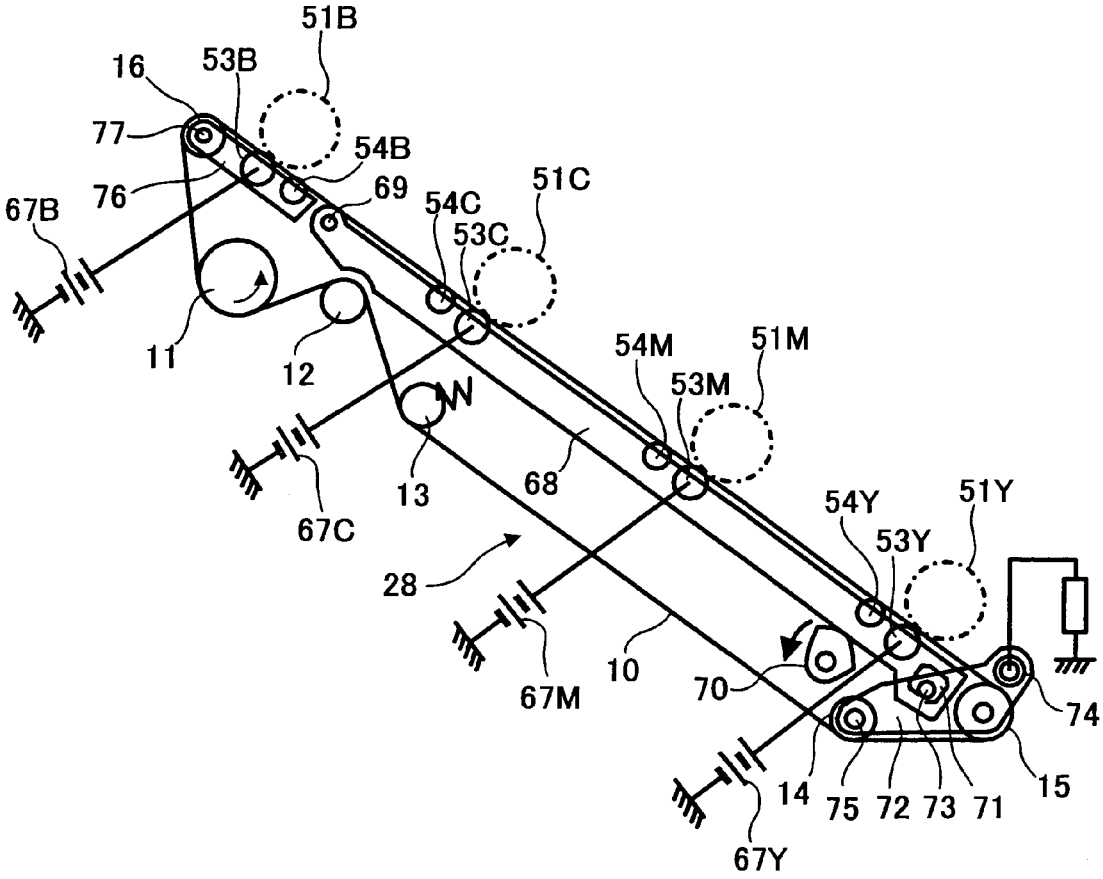
FIG. 9 is an enlarged diagram of the belt driving controller of the color image forming apparatus shown in FIG. 8.

FIG. 9 is an enlarged diagram of the belt driving controller 28 in the color image forming apparatus in FIG. 8.

The endless belt 10 as the transfer material conveying member is formed with PVDF (polyvinylidene fluoride) so that its volume resistivity is at $10^9$ to $10^{11}$ Ωcm, and the belt 10 is wound on the driving roller 11 and the driven rollers 12 to 16 as explained above. Similarly as explained above (though not shown), the encoder is attached to one driven roller 12 among the driven rollers 12 to 16. The rotation of the drive motor is decelerated and transmitted to the driving roller 11 via the drive transmitting unit. The driving roller 11 is driven and rotated based on a signal from the encoder, and the endless belt 10 is driven while the driven rollers 12 to 16 are rotated as the endless belt 10 moves.

Transfer bias power sources 67Y, 67M, 67C, and 67B that apply a transfer bias are connected to core bars of the bias rollers 53Y, 53M, 53C, and 53B, respectively, in the belt driving controller 28 according to the depicted embodiment. The bias rollers 53Y, 53M, 53C and the backup rollers 54Y, 54M, 54C other than the rollers for black rotatably support one swinging bracket 68, respectively.

The swinging bracket 68 is swingably supported about a supporting shaft 69, and biased by a biasing member (not shown) to be abutted against a cam 70. A hole 71 is provided at the tip of the swinging bracket 68 and is engaged with a pin 73 which is hanged up in an inlet bracket 72. The inlet bracket 72 supports the driven roller 14, the driven roller (inlet roller) 15, and an absorbing roller 74, and is rotatable about a supporting shaft 75.

During image forming with only black, the cam 70 is pivoted in a direction indicated by an arrow to swing the swinging bracket 68 about the supporting shaft 69 clockwise. The inlet bracket 72 is operated via the engagement between the hole 71 and the pin 73 to be pivoted about the supporting shaft 75 clockwise. The bias rollers 53Y, 53M, 53C and the backup rollers 54Y, 54M, 54C are separated from the respective photosensitive elements 51Y, 51M, and 51C other than that for black, and the endless belt 10 is also detached so that the driven roller (inlet roller) 15 and the absorbing roller 74 are also moved downward.

The bias roller 53B and the backup roller 54B for black rotatably support another outlet bracket 76. The outlet bracket 76 is pivotable about a supporting shaft 77 of the driven roller (outlet roller) 16. When the belt driving controller 28 is detached from a body (not shown) of the color image forming apparatus, the outlet bracket 76 is pivoted clockwise through handle operation (not shown) to separate the bias roller 53B and the backup roller 54B from the photosensitive element 51B for black.

Also in the belt driving controller 28 in FIG. 9, though the radius r1 of the driving roller 11 is set at twice the radius r2 of the driven roller 12, the winding angle θ1 of the driving roller 11 is set at 115 degrees while the winding angle θ2 of the driven roller 12 is set at 30 degrees. When these values are replaced with the correction coefficient ratio ($\alpha 2/\alpha 1$) obtained from the relational curve of the winding angle θ and the correction coefficient α, the radius r1 is set at about ½ of r2.

Thus, $(\alpha 2/\alpha 1)\times(r1/r2)=1$ is obtained so that the driving fluctuation of the belt caused by the fluctuation in the thickness of the belt is similar as in the driving shaft control. Since other frequency is controllable, the effect of the control will comprehensively appear. Thereby, the endless belt 10 can be effectively controlled so that a high quality image having reduced color shifting and banding can be obtained.

When ($\alpha 2/\alpha 1$) is set at less than 1, not limited to the case where $(\alpha 2/\alpha 1)\times(r1/r2)$ is set at equal to or less than 1, even when the ratio (r1/r2) of the radii of the driving roller 11 and the driven roller 12 cannot be set as expected, the driving fluctuation of the belt can be reduced for the fluctuation components of the thickness of the belt. Thus, the permissible range of the fluctuation in the belt can be widened.

When the ratio (r1/r2) of the radii of the driving roller 11 and the driven roller 12 is set at less than 1, even when the ratio ($\alpha 2/\alpha 1$) of the correction coefficients of the driving roller 11 and the driven roller 12 cannot be set as expected, the degree of deteriorating the driving fluctuation of the belt can be reduced for the fluctuation components of the thickness of the belt, and the permissible range of the fluctuation in the thickness of the belt can be widened.

The embodiment in FIG. 8 explains the case where the present invention is applied to the direct transfer type image forming apparatus that directly transfers an image on the photosensitive element onto a transfer material, but the present invention may be applied to an indirect transfer type image forming apparatus where an image on the photosensitive element is temporarily transferred on an intermediate transfer element to be indirectly transferred on a transfer material, and the transfer material may be conveyed by the similar belt driving controller 28.

There has been explained the case where the present invention is applied to the image forming apparatus where the four image forming units are arranged in tandem manner. But the present invention may be applied to an image forming apparatus where any number of image forming units may be employed, any type other than the tandem type may be employed and not only a color image but also a monochrome image may be formed, and the transfer material may be conveyed by the similar belt driving controller 28.

Figure 10:
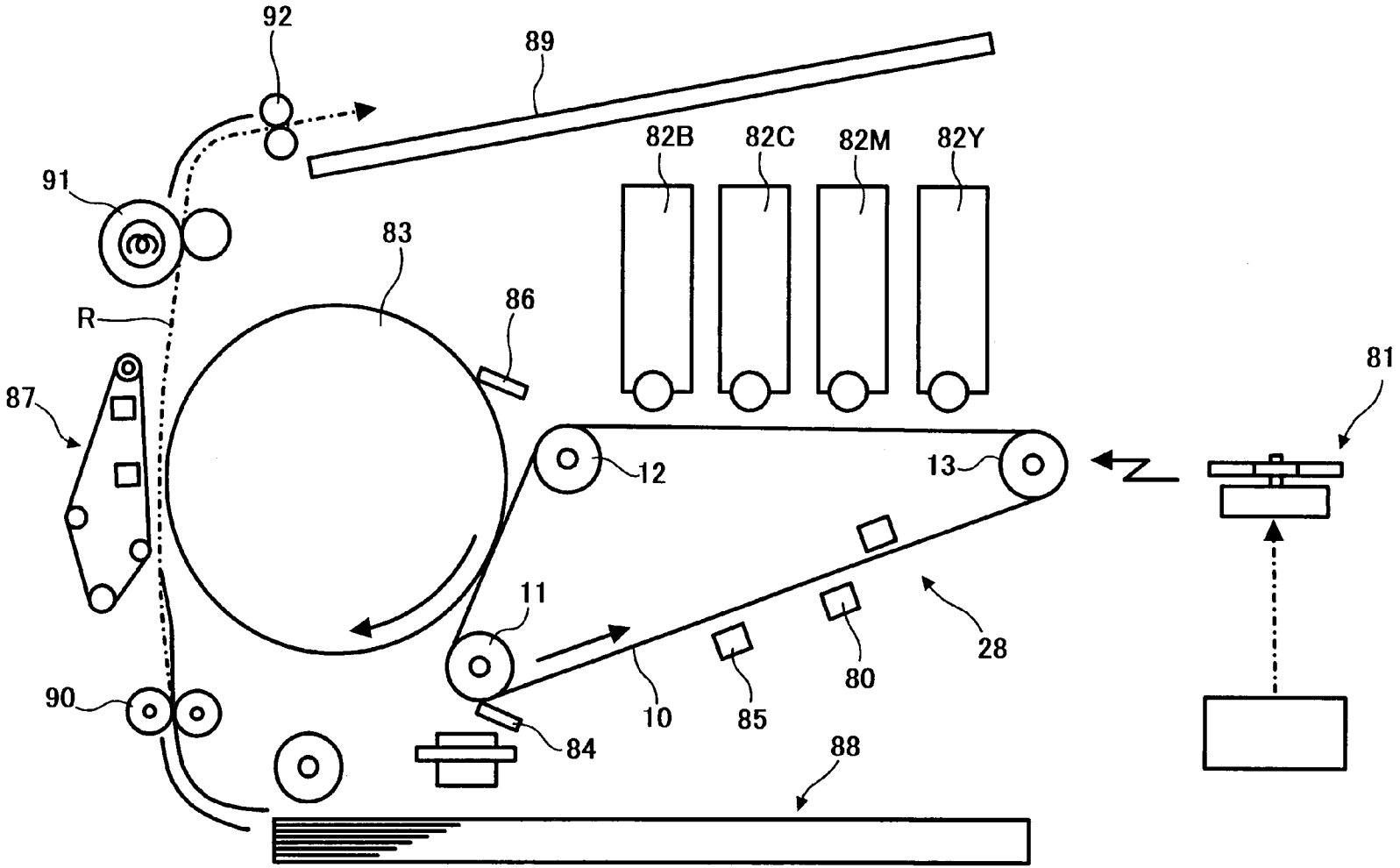
FIG. 10 is a schematic diagram of an essential part of the color image forming apparatus where the belt driving controller shown in FIG. 1 is applied to a unit that drives a belt-type photosensitive element.

FIG. 10 is a schematic diagram of an essential part of the color image forming apparatus where the belt driving controller 28 is applied to a unit that travels on a belt-type photosensitive element.

The endless belt 10 in the belt driving controller 28 is utilized as a photosensitive element which is one example of the image carrier. The endless belt 10 as the photosensitive element is formed by providing a photosensitive layer such as an organic photosemiconductor (OPC) on the outer periphery of a nickel-made belt material in a laminated manner, and is wound on the driving roller 11 and the two driven rollers 12 and 13.

Around the endless belt 10, a charging unit 80, an exposing unit 81, four developing units 82Y, 82M, 82C, and 82B for yellow Y, magenta M, cyan C, and black B, a drum-like intermediate transfer element 83, a primary cleaning unit 84, a discharging unit 85, and the like are arranged. The four developing units 82Y, 82M, 82C, and 82B are provided along the endless belt 10, which is horizontally extended between the two driven rollers 12 and 13. A secondary cleaning unit 86 and a transfer conveying unit 87 are arranged around the drum-like intermediate transfer element 83.

The image forming apparatus is provided with the transfer material conveying route R that leads from a lower transfer material storage unit 88 through the transfer position between the intermediate transfer element 83 and the transfer conveying unit 86 to an upper transfer material stacking unit 89. A resist roller pair 90 and the like in front of the transfer position, and a fixing unit 91, a feeding roller pair 92, and the like behind the transfer position along the transfer material conveying route R are provided.

The endless belt 10 is rotated counterclockwise in the drawing to be charged by the charging unit 80, and writing is performed by the exposing unit 81. One of the developing units 82Y, 82M, 82C, and 82B is used to sequentially perform developing, and monochrome toner images having different colors are sequentially formed for each color on the endless belt 10 as one photosensitive element by one rotation, and the respective monochrome toner images are sequentially transferred by one color to form a combined toner image on the intermediate transfer element 83. The combined toner image is collectively transferred to form a multicolor image on a transfer material conveyed on the transfer material conveying route R.

Though not shown, also in the image forming apparatus, similarly as in the embodiment explained above, the encoder is attached to one driven roller 12 among the two driven roller 12 and 13, the rotation of the drive motor is decelerated and transmitted to the driving roller 11 via the drive transmitting unit. The rotation of the driving roller 11 is feedback-controlled based on the signal from the encoder, and the endless belt 10 is driven while the driven rollers 12 and 13 are rotated as the endless belt 10 moves.

In the embodiment in FIG. 10, though the radius r1 of the driving roller 11 and the radius r2 of the driven roller 12 are set to be substantially identical, the winding angle θ2 of the driven roller 12 is set to be smaller than the winding angle θ1 of the driving roller 11. Therefore, $\alpha 2/\alpha 1$ is set at equal to or less than 1 so that the driving fluctuation of the belt can be reduced for the fluctuation components of the thickness of the belt. Therefore, the permissible range of the fluctuation in the thickness can be widened.

Also when the ratio (r1/r2) of the radii of the driving roller 11 and the driven roller 12 is set at less than 1, the driving fluctuation of the belt can be similarly reduced for the fluctuation components of the thickness of the belt. Therefore, the permissible range of the fluctuation in the thickness of the belt can be widened.

When $(\alpha 2/\alpha 1)\times(r1/r2)$ is set at equal to or less than 1, a good driving control system can be realized for the fluctuation in the thickness without increasing the fluctuation so that the endless belt 10 can be effectively controlled and a high quality image having reduced color shifting and banding can be obtained.

Though an image on the photosensitive elements is primarily transferred on the intermediate transfer element and then secondarily transferred on a transfer material in the image forming apparatus in FIG. 10, the present invention may be applied to an image forming apparatus where an image on the photosensitive element is directly transferred on a transfer material, and the photosensitive element may be driven and controlled as the endless belt. An image formed on the endless belt may not be limited to be in multiple colors, and may be in one color.

Figure 11:
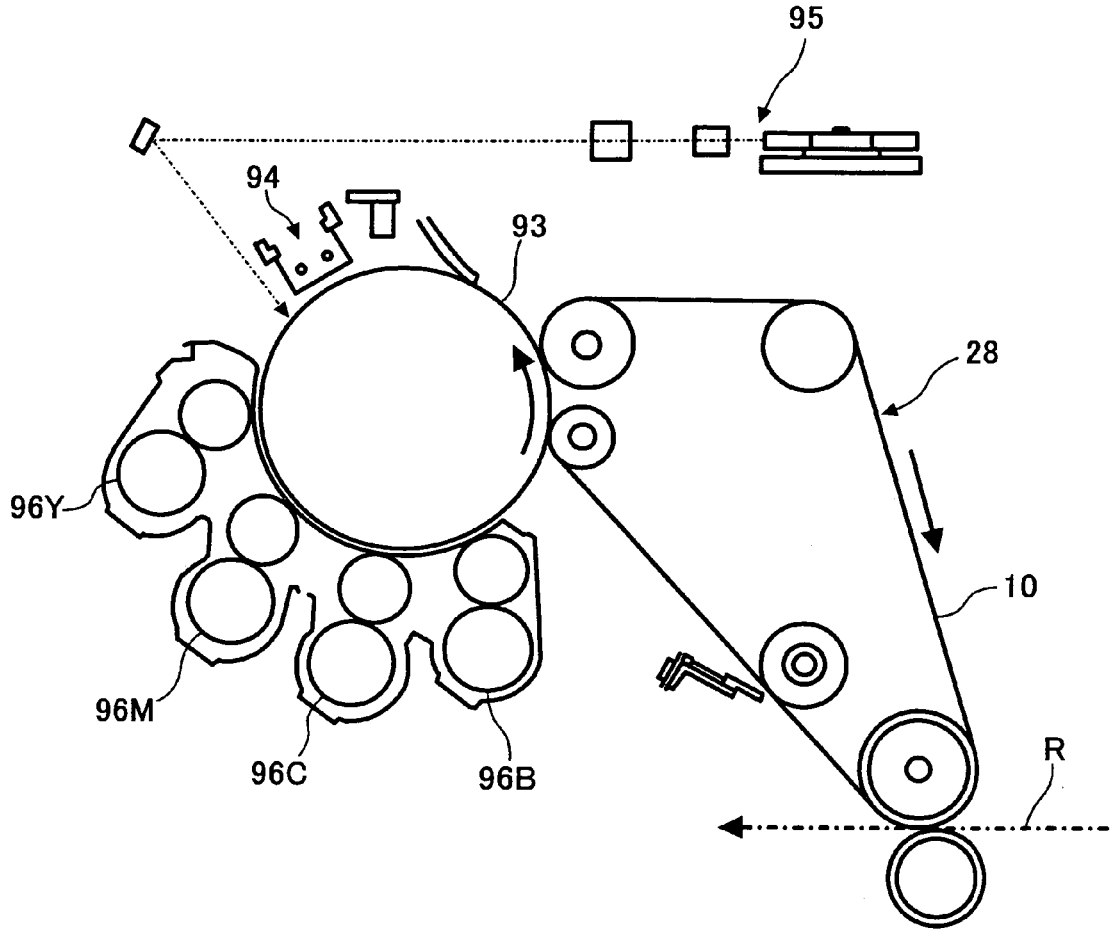
FIG. 11 is a schematic diagram of the color image forming apparatus where the belt driving controller shown in FIG. 1 is applied to a unit that drives a belt-type intermediate transfer element.

FIG. 11 is a schematic diagram of the color image forming apparatus where the belt driving controller 28 is applied to a unit that drives a belt-type intermediate transfer element.

In the embodiment in FIG. 11, one drum-like photosensitive element 93 is rotated counterclockwise to be charged by a charging unit 94, and an exposing unit 95 performs writing. One of developing units 96Y, 96M, 96C, and 96B is used to sequentially perform developing. Monochrome toner images having different colors are sequentially formed for each color by one rotation of the photosensitive element 93, and the respective monochrome toner images are sequentially transferred by one color to form a combined toner image on the endless belt 10 in the belt driving controller 28. The combined toner image is collectively transferred to form a multicolor image on a transfer material conveyed on the transfer material conveying route R. In other words, the endless belt 10 in the belt driving controller 28 is utilized as the belt-type intermediate transfer element which is one example of the image carrier.

In this case, the endless belt 10 as the intermediate transfer element is formed on a base layer made of less-elastic fluorocarbon resin or less-elastic material such as sailcloth in place of elastic rubber material, and an elastic layer is provided thereon. The elastic layer is made of fluorocarbon rubber, acrylonitrile-butadiene copolymer, or the like. The surface of the elastic layer is coated with a smooth coat layer on which fluorocarbon resin is coated.

Figure 12:
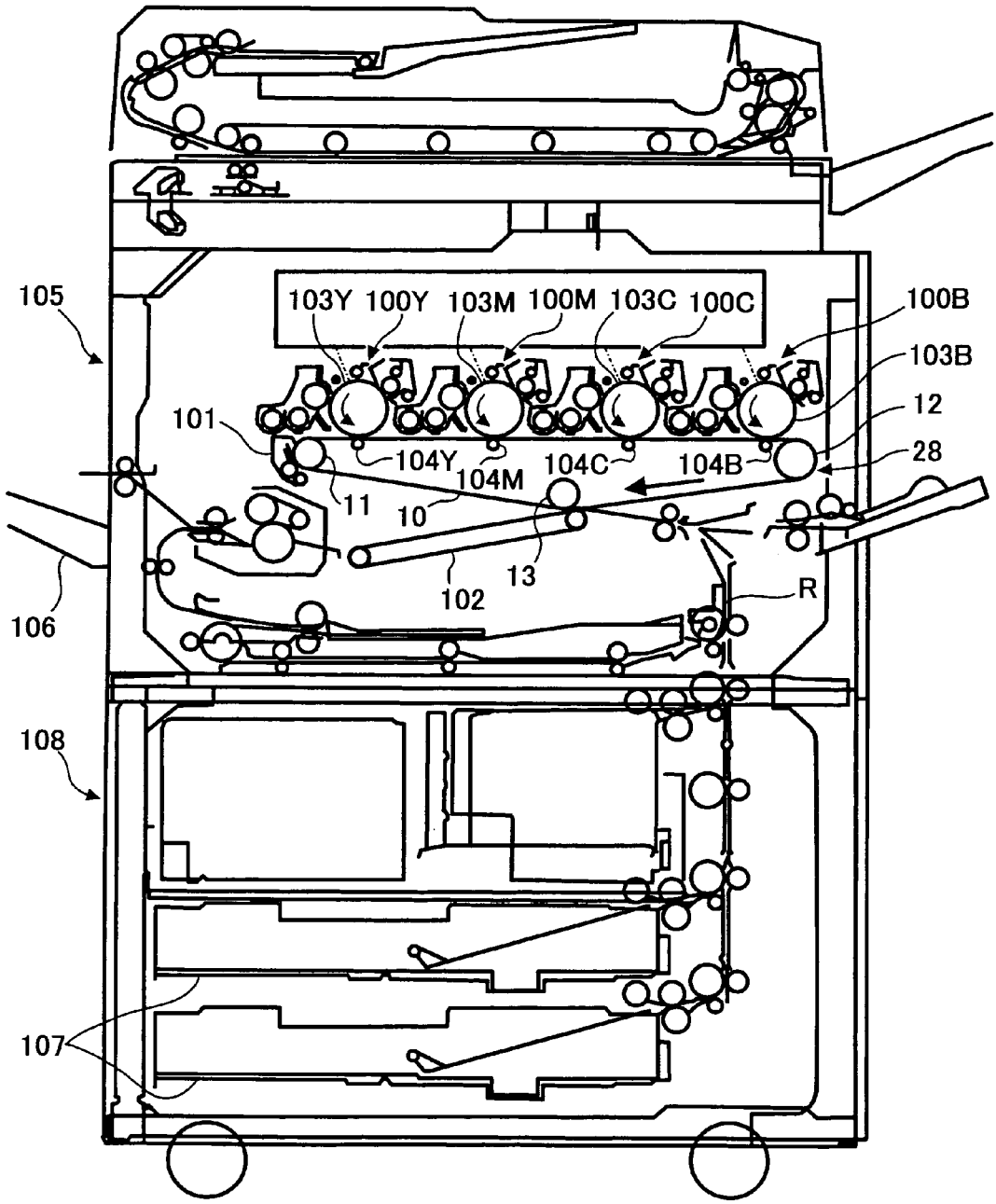
FIG. 12 is a schematic diagram of a color image forming apparatus according to another embodiment of the present invention where the belt driving controller shown in FIG. 1 is applied to a unit that drives a belt-type intermediate transfer element.

FIG. 12 is a schematic diagram of a color image forming apparatus according to another embodiment of the present invention where the belt driving controller 28 is applied to a unit that drives the belt-type intermediate transfer element.

In the embodiment in FIG. 12, the endless belt 10 in the belt driving controller 28 is utilized as the belt-type intermediate transfer element which is one example of the image carrier. The endless belt 10 as the intermediate transfer element is provided with an elastic layer on the base layer similarly as in the previous embodiment, and the surface of the elastic layer is coated with a coat layer. The endless belt 10 is wound on the driving roller 11 and the two driven rollers 12 and 13.

Around the endless belt 10, four image forming units 100Y, 100M, 100C, and 100B that are arranged in a tandem manner, a cleaning unit 101, a transfer conveying unit 102, and the like are provided. The image forming unit 100Y, 100M, 100C, or 100B includes a charging unit, a developing unit, a cleaning unit, and the like around each of photosensitive elements 103Y, 103M, 103C, or 103B, respectively, and a common exposing unit 104 is provided thereon. Transfer rollers 104Y, 104M, 104C, and 104B are abutted against the photosensitive elements 103Y, 103M, 103C, and 103B across the endless belt 10, respectively.

A body 105 of the image forming apparatus includes, at its side, a stack tray 106, which is placed on a mounting table 108 having a plurality of transfer material cassettes 107 in multiple stages. The transfer material conveying route R is formed, which leads from each transfer material cassette through the position between the endless belt 10 and the transfer conveying apparatus 102 to the stack tray 106.

Monochrome toner images having different colors are formed on the respective photosensitive elements 103Y, 103M, 103C, and 103B of the four image forming units 100Y, 100M, 100C, and 100B, and the respective monochrome toner images are sequentially transferred to form a combined toner image on the endless belt 10 as the intermediate transfer element. The combined toner image is collectively transferred by the transfer conveying unit 102 to form a multicolor image on a transfer material conveyed on the transfer material conveying route R.

In the embodiment in FIG. 12, though the radius r1 of the driving roller 11 and the radius r2 of the driven roller 12 are set to be substantially identical, the winding angle $\theta 2$ of the driven roller 12 is set to be smaller than the winding angle $\theta 1$ of the driving roller 11. Thus, $\alpha 2/\alpha 1$ is set at equal to or less than 1 so that the degree of deteriorating the driving fluctuation of the belt can be reduced for the fluctuation components of the thickness of the belt. Therefore, the permissible range of the fluctuation in the thickness can be widened.

Even when the ratio (r1/r2) of the radii of the driving roller 11 and the driven roller 12 is set at less than 1, the driving fluctuation of the belt can be similarly reduced for the fluctuation components of the thickness of the belt. Therefore, the permissible range of the fluctuation in the thickness can be widened.

When $(\alpha 2/\alpha 1)\times(r1/r2)$ is set at equal to or less than 1, a good driving control system can be realized for the fluctuation in the thickness of the belt without increasing the fluctuation. Thus, the endless belt 10 can be effectively controlled and a high quality image with reduced color shifting and banding can be obtained.

Figure 13:
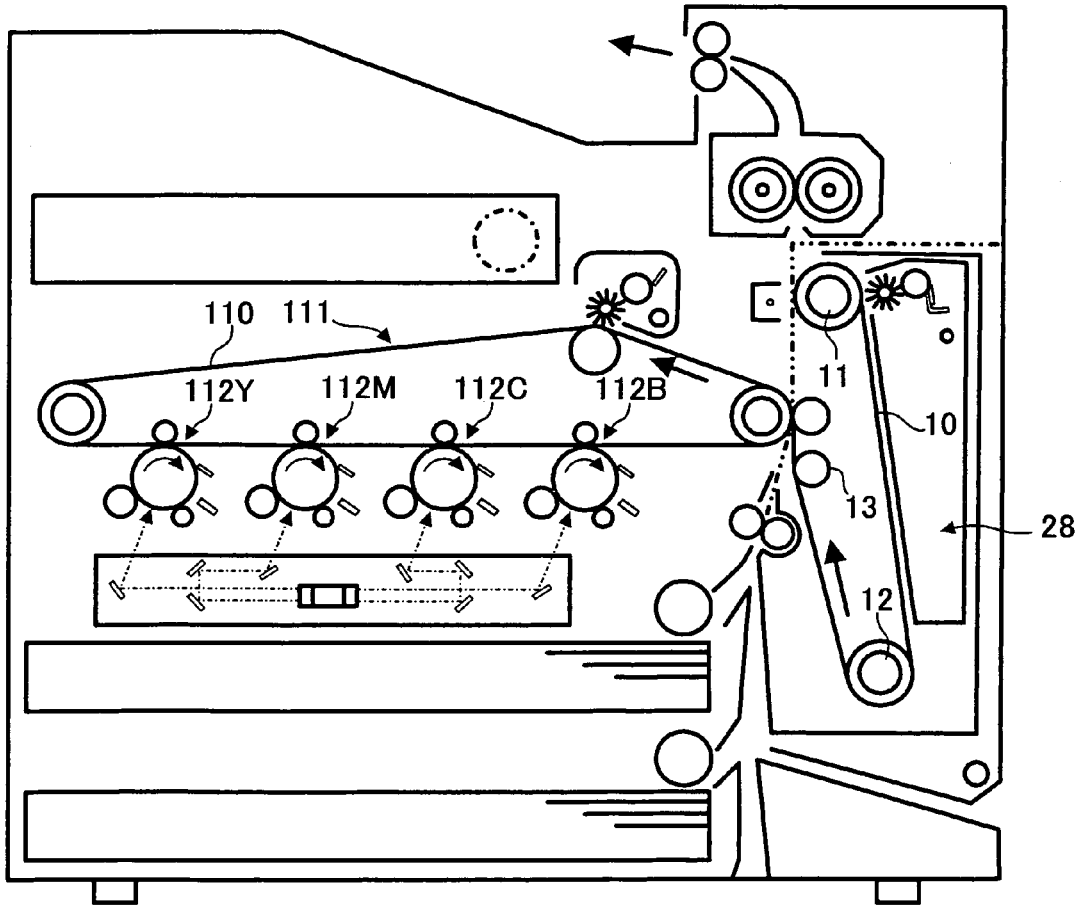
FIG. 13 is a schematic diagram of a color image forming apparatus according to still another embodiment of the present invention where the belt driving controller shown in FIG. 1 is applied to a unit that drives a belt-type intermediate transfer element.

FIG. 13 is a schematic diagram of a color image forming apparatus according to still another embodiment of the present invention where the belt driving controller 28 is applied to a unit that drives on the belt-type intermediate transfer element.

In the embodiment in FIG. 13, the endless belt 10 in the belt driving controller 28 is utilized as a belt-type secondary intermediate transfer element which is one example of the image carrier. The endless belt 10 as the secondary intermediate transfer element is provided with an elastic layer on the base layer similarly as in the above embodiment and the surface of the elastic layer is coated with a coat layer so that the endless belt 10 is wound on the driving roller 11 and the two driven rollers 12 and 13.

The endless belt 10 as the secondary intermediate transfer element in the belt driving controller 28 is provided with a primary intermediate transferring unit 111 in contact with a belt-type primary intermediate transfer element 110. Four image forming units 112Y, 112M, 112C, and 112B are provided around the primary intermediate transfer element 110 of the primary intermediate transferring unit 111.

Images are first formed in the respective image forming units 112Y, 112M, 112C, and 112B for each color, and the images are temporarily transferred on the primary intermediated transfer body 110 and secondarily transferred on the endless belt 10 to carry the first image on the endless belt 10. Next, images are additionally formed in the image forming units 112Y, 112M, 112C, and 112B for each color and the images are transferred on the primary intermediate transfer element 110 to carry the second image on the primary intermediate transfer element 110.

Then, a transfer material is led between the belt driving controller 28 and the primary intermediate transferring unit 111 through the transfer material conveying route R, and the first image carried on the endless belt 10 as the secondary intermediate transfer element and the second image carried on the primary intermediate transfer element 110 are transferred substantially simultaneously to form toner images on both sides of the transfer material.

In this manner, in the double-side image forming apparatus in FIG. 13, the belt driving controller may be applied to the secondary intermediate transferring unit, and the driving roller 11 of the belt-type secondary intermediate transfer element may be feedback-controlled.

The belt driving controller 28 may be constituted of an image carrier such as a photosensitive element or an intermediate transfer element, and the process cartridge may be constituted of the belt driving controller, and the process cartridge may be collectively detachable relative to the body of the image forming apparatus.

According to the present invention, when the encoder is attached to the driven roller to control the endless belt, a good driving control system can be constructed for the fluctuation components of the thickness of the belt without increasing the fluctuation as compared with the case where the endless belt is not controlled, that is, the case where driving shaft control is performed. Thus, it is possible to provide the belt driving controller that enables the endless belt to travel at a constant speed without influence by the fluctuation in the thickness of the belt.

Furthermore, according to the present invention, the belt driving fluctuation relative to the fluctuation components of the thickness of the belt can be reduced and a permissible range of the fluctuation in the thickness of the belt can be widened even when the ratio (r1/r2) of the radii of the driving roller and the driven roller cannot be set as expected. Thus, it is possible to provide the belt driving controller that enables the endless belt to travel at a constant speed without influence by the fluctuation in the thickness of the belt.

Moreover, according to the present invention, the belt driving fluctuation relative to the fluctuation components of the thickness of the belt can be reduced and the permissible range of the fluctuation in the thickness can be widened even when the ratio ($\alpha 2/\alpha 1$) of the correction coefficients of the driving roller and the driven roller cannot be set as expected. Thus, it is possible to provide the belt driving controller that enables the endless belt to travel at a constant speed without influence by the fluctuation in the thickness of the belt.

Furthermore, according to the present invention, it is possible to provide the belt driving controller that enables the endless belt to travel at a constant speed by utilizing the belt-type transfer material conveying member as a traveling unit without influence by the fluctuation in the thickness of the belt.

Moreover, according to the present invention, it is possible to provide the belt driving controller that drives the endless belt suitable as the transfer material conveying member.

Furthermore, according to the present invention, it is possible to provide the belt driving controller that enables the endless belt to travel at a constant speed by utilizing the belt-type image carrier as a traveling unit without being influenced by the fluctuation in the thickness of the belt.

Moreover, according to the present invention, it is possible to provide the belt driving controller that enables the endless belt to travel at a constant speed by using the belt-type photosensitive element as a traveling unit without being influenced by the fluctuation in the thickness of the belt.

Furthermore, according to the present invention, it is possible to provide the belt driving controller that drives the endless belt suitable as the photosensitive element.

Moreover, according to the present invention, it is possible to provide the belt driving controller that enables the endless belt to travel at a constant speed by utilizing the belt-type intermediate transfer element as a traveling unit without being influenced by the fluctuation in the thickness of the belt.

Furthermore, according to the present invention, it is possible to provide the belt driving controller that drives the endless belt suitable as the intermediate transfer element.

Moreover, according to the present invention, it is possible to provide the belt driving controller that enables the endless belt to travel at a constant speed by utilizing the belt-type intermediate transfer element used in the image forming apparatus for simultaneous transfer as a traveling unit without being influenced by the fluctuation in the thickness of the belt.

Furthermore, according to the present invention, it is possible to provide the process cartridge of the image forming apparatus that includes the belt driving controller capable of traveling on the endless belt at a constant speed and can acquire high quality images without influence by the fluctuation in the thickness of the belt.

Moreover, according to the present invention, it is possible to provide the image forming apparatus that includes the belt driving controller capable of traveling on the endless belt at a constant speed and can form high quality images without being influenced by the fluctuation in the thickness of the belt.

Furthermore, according to the present invention, it is possible to provide the image forming apparatus that includes the belt driving controller capable of traveling on the endless belt at a constant speed and can form high quality images by using the belt-type transfer material conveying member as a traveling unit without being influenced by the fluctuation in the thickness of the belt.

Moreover, according to the present invention, it is possible to provide the image forming apparatus that includes the belt driving controller capable of traveling on the endless belt at a constant speed and can form high quality images by using the belt-type photosensitive element as a traveling unit without being influenced by the fluctuation in belt the thickness.

Furthermore, according to the present invention, it is possible to provide the image forming apparatus that includes the belt driving controller capable of traveling on the endless belt at a constant speed and can form high quality images by using the belt-type intermediate transfer element as a traveling unit without being influenced by the fluctuation in the thickness of the belt.

Moreover, according to the present invention, it is possible to provide the image forming apparatus that includes the belt driving controller capable of traveling on the endless belt at a constant speed and can form high quality images by using the belt-type intermediate transfer element used in the image forming apparatus for simultaneous transfer as a traveling unit without influence by the fluctuation in the thickness of the belt.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A belt driving controller comprising:

a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on the signal from the encoder, and following relation is satisfied $$(\alpha 2/\alpha 1)\times(r1/r2)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

2. The belt driving controller according to claim 1, wherein the endless belt is a transfer material conveying member that conveys a transfer material on which a toner image formed on a photosensitive element is directly or indirectly transferred to form an image in an image forming apparatus.

3. The belt driving controller according to claim 2, wherein the transfer material conveying member is formed with polyvinylidene fluoride such that volume resistivity is $10^9$ to $10^{11}$ Ωcm.

4. The belt driving controller claim 1, wherein the endless belt is an image carrier on which a toner image is carried, the toner directly or indirectly transferred to a transfer material to form an image.

5. The belt driving controller according to claim 4, wherein the image carrier is a belt-type photosensitive element.

6. The belt driving controller according to claim 5, wherein the endless belt includes a belt base, and the photosensitive element is a thin layer that is formed with a photosensitive layer on an outer periphery of the belt base.

7. The belt driving controller according to claim 4, wherein the image carrier is a belt-type intermediate transfer element on which a toner image on a photosensitive element is transferred.

8. The belt driving controller according to claim 7, wherein the intermediate transfer element has a structure including a base layer, an elastic layer over the base layer, and a coat layer that coats a surface of the elastic layer.

9. The belt driving controller according to claim 4, wherein the belt driving controller is provided in an image forming apparatus that transfers a first image and a second image that are formed in an image forming unit to form a toner image on both sides of a transfer material substantially at the same time, and the image carrier is a belt-type intermediate transfer element on which an image that is previously formed in the image forming unit is transferred as the first image.

10. A belt driving controller comprising:

a driving roller;

a plurality of driven rollers that is driven by rotation of the driving roller;

an endless belt that is wound on the driving roller and the driven rollers; and an encoder that is attached to one of the driven rollers, and that outputs a signal, wherein following relation is satisfied $$(\alpha 2/\alpha 1) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

11. The belt driving controller according to claim 10, wherein the endless belt is a transfer material conveying member that conveys a transfer material on which a toner image formed on a photosensitive element is directly or indirectly transferred to form an image in an image forming apparatus.

12. The belt driving controller according to claim 11, wherein the transfer material conveying member is formed with polyvinylidene fluoride such that volume resistivity is $10^9$ to $10^{11}$ Ωcm.

13. The belt driving controller according to claim 10, wherein the endless belt is an image carrier on which a toner image is carried, the toner directly or indirectly transferred to a transfer material to form an image.

14. The belt driving controller according to claim 13, wherein the image carrier is a belt-type photosensitive element.

15. The belt driving controller according to claim 14, wherein the endless belt includes a belt base, and the photosensitive element is a thin layer that is formed with a photosensitive layer on an outer periphery of the belt base.

16. The belt driving controller according to claim 13, wherein the image carrier is a belt-type intermediate transfer element on which a toner image on a photosensitive element is transferred.

17. The belt driving controller according to claim 16, wherein the intermediate transfer element has a structure including a base layer, an elastic layer over the base layer, and a coat layer that coats a surface of the elastic layer.

18. The belt driving controller according to claim 13, wherein the belt driving controller is provided in an image forming apparatus that transfers a first image and a second image that are formed in an image forming unit to form a toner image on both sides of a transfer material substantially at the same time, and the image carrier is a belt-type intermediate transfer element on which an image that is previously formed in the image forming unit is transferred as the first image.

19. A belt driving controller comprising:

a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on a signal from the encoder, and following relation is satisfied $$(r1/r2) \leqq 1.$$

20. The belt driving controller according to claim 19, wherein the endless belt is a transfer material conveying member that conveys a transfer material on which a toner image formed on a photosensitive element is directly or indirectly transferred to form an image in an image forming apparatus.

21. The belt driving controller according to claim 20, wherein the transfer material conveying member is formed with polyvinylidene fluoride such that volume resistivity is $10^9$ to $10^{11}$ Ωcm.

22. The belt driving controller according to claim 19, wherein the endless belt is an image carrier on which a toner image is carried, the toner directly or indirectly transferred to a transfer material to form an image.

23. The belt driving controller according to claim 22, wherein the image carrier is a belt-type photosensitive element.

24. The belt driving controller according to claim 23, wherein the endless belt includes a belt base, and the photosensitive element is a thin layer that is formed with a photosensitive layer on an outer periphery of the belt base.

25. The belt driving controller according to claim 22, wherein the image carrier is a belt-type intermediate transfer element on which a toner image on a photosensitive element is transferred.

26. The belt driving controller according to claim 25, wherein the intermediate transfer element has a structure including a base layer, an elastic layer over the base layer, and a coat layer that coats a surface of the elastic layer.

27. The belt driving controller according to claim 22, wherein the belt driving controller is provided in an image forming apparatus that transfers a first image and a second image that are formed in an image forming unit to form a toner image on both sides of a transfer material substantially at the same time, and the image carrier is a belt-type intermediate transfer element on which an image that is previously formed in the image forming unit is transferred as the first image.

28. A process cartridge comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on the signal from the encoder, and following relation is satisfied $$(\alpha 2/\alpha 1)\times(r1/r2)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

29. A process cartridge comprising a belt driving controller that includes a driving roller;

a plurality of driven rollers that is driven by rotation of the driving roller;

an endless belt that is wound on the driving roller and the driven rollers; and an encoder that is attached to one of the driven rollers, and that outputs a signal, wherein following relation is satisfied $$(\alpha 2/\alpha 1)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

30. A process cartridge comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on a signal from the encoder, and following relation is satisfied $$(r1/r2)\leqq 1.$$

31. An image forming apparatus comprising a process cartridge that includes a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on a signal from the encoder, and following relation is satisfied $$(\alpha 2/\alpha 1)\times(r1/r2)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

32. An image forming apparatus comprising a process cartridge that includes a belt driving controller that includes a driving roller;

a plurality of driven rollers that is driven by rotation of the driving roller;

an endless belt that is wound on the driving roller and the driven rollers; and an encoder that is attached to one of the driven rollers, and that outputs a signal, wherein following relation is satisfied $$(\alpha 2/\alpha 1)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

33. An image forming apparatus comprising a process cartridge that includes a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on a signal from the encoder, and following relation is satisfied $$(r1/r2)\leqq 1.$$

34. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on the signal from the encoder, and following relation is satisfied $$(\alpha 2/\alpha 1)\times(r1/r2)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

35. An image forming apparatus comprising a belt driving controller that includes a driving roller;

a plurality of driven rollers that is driven by rotation of the driving roller;

an endless belt that is wound on the driving roller and the driven rollers; and an encoder that is attached to one of the driven rollers, and that outputs a signal, wherein following relation is satisfied $$(\alpha 2/\alpha 1)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller.

36. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on a signal from the encoder, and following relation is satisfied $$(r1/r2)\leqq 1.$$

37. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on the signal from the encoder, and following relation is satisfied $$(\alpha 2/\alpha 1)\times(r1/r2)\leqq 1$$

where α1 is a correction coefficient for a fluctuation in thickness of the endless belt caused by a belt winding angle on the driving roller, and α2 is a correction coefficient for a fluctuation in the thickness on the driven roller, wherein the endless belt is a transfer material conveying member that conveys a transfer material on which a toner image formed on a photosensitive element is directly or indirectly transferred to form an image in an image forming apparatus, and the apparatus forms monochrome toner images in different colors on the photosensitive elements, and sequentially transfers each of the monochrome toner images to a transfer material to form a combined toner image.

38. An image forming apparatus comprising a belt driving controller that includes a driving roller;

a plurality of driven rollers that is driven by rotation of the driving roller;

an endless belt that is wound on the driving roller and the driven rollers; and an encoder that is attached to one of the driven rollers, and that outputs a signal, wherein following relation is satisfied $$(\alpha 2/\alpha 1)\leqq 1$$

where α1 is a correction coefficient for a fluctuation in thickness of the endless belt caused by a belt winding angle on the driving roller, and α2 is a correction coefficient for a fluctuation in the thickness on the driven roller, the endless belt is a transfer material conveying member that conveys a transfer material on which a toner image formed on a photosensitive element is directly or indirectly transferred to form an image in an image forming apparatus, and the apparatus forms monochrome toner images in different colors on the photosensitive elements, and sequentially transfers each of the monochrome toner images to a transfer material to form a combined toner image.

39. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on a signal from the encoder, following relation is satisfied $$(r1/r2)\leqq 1,$$

the endless belt is a transfer material conveying member that conveys a transfer material on which a toner image formed on a photosensitive element is directly or indirectly transferred to form an image in an image forming apparatus, and the apparatus forms monochrome toner images in different colors on the photosensitive elements, and sequentially transfers each of the monochrome toner images to a transfer material to form a combined toner image.

40. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on the signal from the encoder, following relation is satisfied $$(\alpha 2/\alpha 1)\times(r1/r2)\leqq 1$$

where α1 is a correction coefficient for a fluctuation in thickness of the endless belt caused by a belt winding angle on the driving roller, and α2 is a correction coefficient for a fluctuation in the thickness on the driven roller, the endless belt is an image carrier on which a toner image is carried, the toner directly or indirectly transferred to a transfer material to form an image, the image carrier is a belt-type photosensitive element, and the apparatus forms a monochrome toner image on the photosensitive element and directly transfers the toner image to the transfer material to form an image.

41. An image forming apparatus comprising a belt driving controller that includes a driving roller;

a plurality of driven rollers that is driven by rotation of the driving roller;

an endless belt that is wound on the driving roller and the driven rollers; and an encoder that is attached to one of the driven rollers, and that outputs a signal, wherein following relation is satisfied $$(\alpha 2/\alpha 1)\leqq 1$$

where α1 is a correction coefficient for a fluctuation in thickness of the endless belt caused by a belt winding angle on the driving roller, and α2 is a correction coefficient for a fluctuation in the thickness on the driven roller, the endless belt is an image carrier on which a toner image is carried, the toner directly or indirectly transferred to a transfer material to form an image, the image carrier is a belt-type photosensitive element, and the apparatus forms a monochrome toner image on the photosensitive element and directly transfers the toner image to the transfer material to form an image.

42. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on a signal from the encoder, following relation is satisfied $$(r1/r2) \leqq 1,$$

the endless belt is an image carrier on which a toner image is carried, the toner directly or indirectly transferred to a transfer material to form an image, the image carrier is a belt-type photosensitive element, and the apparatus forms a monochrome toner image on the photosensitive element and directly transfers the toner image to the transfer material to form an image.

43. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on the signal from the encoder, following relation is satisfied $$(\alpha 2/\alpha 1) \times (r1/r2) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller, the endless belt is an image carrier on which a toner image is carried, the toner directly or indirectly transferred to a transfer material to form an image, the image carrier is a belt-type photosensitive element, and the apparatus sequentially forms monochrome toner images in different colors on one of the photosensitive elements, sequentially transfers each of the monochrome toner images to an intermediate transfer element to form a combined toner image, and collectively transfers the combined toner image to the transfer material to form a multicolor image.

44. An image forming apparatus comprising a belt driving controller that includes a driving roller;

a plurality of driven rollers that is driven by rotation of the driving roller;

an endless belt that is wound on the driving roller and the driven rollers; and an encoder that is attached to one of the driven rollers, and that outputs a signal, wherein following relation is satisfied $$(\alpha 2/\alpha 1) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller, the image carrier is a belt-type photosensitive element, the image carrier is a belt-type photosensitive element, and the apparatus sequentially forms monochrome toner images in different colors on one of the photosensitive elements, sequentially transfers each of the monochrome toner images to an intermediate transfer element to form a combined toner image, and collectively transfers the combined toner image to the transfer material to form a multicolor image.

45. An image forming apparatus comprising a belt driving controller that includes:

a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on a signal from the encoder, following relation is satisfied $$(r1/r2) \leqq 1,$$

the endless belt is an image carrier on which a toner image is carried, the toner directly or indirectly transferred to a transfer material to form an image, the image carrier is a belt-type photosensitive element, and the apparatus sequentially forms monochrome toner images in different colors on one of the photosensitive elements, sequentially transfers each of the monochrome toner images to an intermediate transfer element to form a combined toner image, and collectively transfers the combined toner image to the transfer material to form a multicolor image.

46. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on the signal from the encoder, following relation is satisfied $$(\alpha 2/\alpha 1) \times (r1/r2) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller, the endless belt is an image carrier on which a toner image is carried, the toner directly or indirectly transferred to a transfer material to form an image, the image carrier is a belt-type intermediate transfer element on which a toner image on a photosensitive element is transferred, and the apparatus forms monochrome toner images in different colors on one of the photosensitive elements, sequentially transfers each of the respective monochrome toner images to the intermediate transfer element to form a combined toner image, and collectively transfers the combined toner image to the transfer material to form a multicolor image.

47. An image forming apparatus comprising a belt driving controller that includes a driving roller;

a plurality of driven rollers that is driven by rotation of the driving roller;

an endless belt that is wound on the driving roller and the driven rollers; and an encoder that is attached to one of the driven rollers, and that outputs a signal, wherein following relation is satisfied $$(\alpha 2/\alpha 1) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller, the endless belt is an image carrier on which a toner image is carried, the toner directly or indirectly transferred to a transfer material to form an image, the image carrier is a belt-type intermediate transfer element on which a toner image on a photosensitive element is transferred, and the apparatus forms monochrome toner images in different colors on one of the photosensitive elements, sequentially transfers each of the respective monochrome toner images to the intermediate transfer element to form a combined toner image, and collectively transfers the combined toner image to the transfer material to form a multicolor image.

48. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on a signal from the encoder, following relation is satisfied $$(r1/r2) \leqq 1,$$

the endless belt is an image carrier on which a toner image is carried, the toner directly or indirectly transferred to a transfer material to form an image, the image carrier is a belt-type intermediate transfer element on which a toner image on a photosensitive element is transferred, and the apparatus forms monochrome toner images in different colors on one of the photosensitive elements, sequentially transfers each of the respective monochrome toner images to the intermediate transfer element to form a combined toner image, and collectively transfers the combined toner image to the transfer material to form a multicolor image.

49. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on the signal from the encoder, and following relation is satisfied $$(\alpha 2/\alpha 1) \times (r1/r2) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller, the endless belt is an image carrier on which a toner image is carried, the toner directly or indirectly transferred to a transfer material to form an image, the image carrier is a belt-type intermediate transfer element on which a toner image on a photosensitive element is transferred, the apparatus forms monochrome toner images in different colors on one of the photosensitive elements, sequentially transfers each of the respective monochrome toner images to the intermediate transfer element to form a combined toner image, and collectively transfers the combined toner image to the transfer material to form a multicolor image, and the apparatus forms monochrome toner images in different colors on the photosensitive elements, sequentially transfers each of the monochrome toner images to the intermediate transfer element to form a combined toner image, and collectively transfers the combined toner image to a transfer material to form a multicolor image.

50. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on the signal from the encoder, following relation is satisfied $$(\alpha 2/\alpha 1) \times (r1/r2) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller, the endless belt is an image carrier on which a toner image is carried, the toner directly or indirectly transferred to a transfer material to form an image, the image carrier is a belt-type intermediate transfer element on which a toner image on a photosensitive element is transferred, and the apparatus forms monochrome toner images in different colors on the photosensitive elements, sequentially transfers each of the monochrome toner images to the intermediate transfer element to form a combined toner image, and collectively transfers the combined toner image to a transfer material to form a multicolor image.

51. An image forming apparatus comprising a belt driving controller that includes a driving roller;

a plurality of driven rollers that is driven by rotation of the driving roller;

an endless belt that is wound on the driving roller and the driven rollers; and an encoder that is attached to one of the driven rollers, and that outputs a signal, wherein following relation is satisfied $$(\alpha 2/\alpha 1) \leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller, the endless belt is an image carrier on which a toner image is carried, the toner directly or indirectly transferred to a transfer material to form an image, the image carrier is a belt-type intermediate transfer element on which a toner image on a photosensitive element is transferred, and the apparatus forms monochrome toner images in different colors on the photosensitive elements, sequentially transfers each of the monochrome toner images to the intermediate transfer element to form a combined toner image, and collectively transfers the combined toner image to a transfer material to form a multicolor image.

52. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on the signal from the encoder, following relation is satisfied $$(\alpha 2/\alpha 1)\times(r1/r2)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller, the endless belt is an image carrier on which a toner image is carried, the toner directly or indirectly transferred to a transfer material to form an image, the belt driving controller is provided in an image forming apparatus that transfers a first image and a second image that are formed in an image forming unit to form a toner image on both sides of a transfer material substantially at the same time, the image carrier is a belt-type intermediate transfer element on which an image that is previously formed in the image forming unit is transferred as the first image, and an image previously formed in the image forming units is temporarily transferred to carry a first image on the belt-type intermediate transfer element and the first image carried on the intermediate transfer element and a second image additionally formed in the image forming units are substantially simultaneously transferred to the transfer material to form a toner image on each side of the transfer material.

53. An image forming apparatus comprising a belt driving controller that includes a driving roller;

a plurality of driven rollers that is driven by rotation of the driving roller;

an endless belt that is wound on the driving roller and the driven rollers; and an encoder that is attached to one of the driven rollers, and that outputs a signal, wherein following relation is satisfied $$(\alpha 2/\alpha 1)\leqq 1$$

where $\alpha 1$ is a correction coefficient for a fluctuation in thickness of the endless belt caused by a belt winding angle on the driving roller, and $\alpha 2$ is a correction coefficient for a fluctuation in the thickness on the driven roller, the endless belt is an image carrier on which a toner image is carried, the toner directly or indirectly transferred to a transfer material to form an image, the belt driving controller is provided in an image forming apparatus that transfers a first image and a second image that are formed in an image forming unit to form a toner image on both sides of a transfer material substantially at the same time, the image carrier is a belt-type intermediate transfer element on which an image that is previously formed in the image forming unit is transferred as the first image, and an image previously formed in the image forming units is temporarily transferred to carry a first image on the belt-type intermediate transfer element and the first image carried on the intermediate transfer element and a second image additionally formed in the image forming units are substantially simultaneously transferred to the transfer material to form a toner image on each side of the transfer material.

54. An image forming apparatus comprising a belt driving controller that includes a driving roller having a radius r1;

a plurality of driven rollers that is driven by rotation of the driving roller, the driven rollers having a radius r2;

an endless belt that is wound on the driving roller and the driven rollers; and an encoder that is attached to one of the driven rollers, and that outputs a signal, wherein the rotation of the driving roller is controlled based on a signal from the encoder, following relation is satisfied $$(r1/r2)\leqq 1,$$

the endless belt is an image carrier on which a toner image is carried, the toner directly or indirectly transferred to a transfer material to form an image, the belt driving controller is provided in an image forming apparatus that transfers a first image and a second image that are formed in an image forming unit to form a toner image on both sides of a transfer material substantially at the same time, the image carrier is a belt-type intermediate transfer element on which an image that is previously formed in the image forming unit is transferred as the first image, and an image previously formed in the image forming units is temporarily transferred to carry a first image on the belt-type intermediate transfer element and the first image carried on the intermediate transfer element and a second image additionally formed in the image forming units are substantially simultaneously transferred to the transfer material to form a toner image on each side of the transfer material.

* * * * *